US007584601B2

(12) United States Patent
Metcalfe, III et al.

(10) Patent No.: US 7,584,601 B2
(45) Date of Patent: Sep. 8, 2009

(54) CHARGED PARTICLE THRUST ENGINE

(76) Inventors: Tristram Walker Metcalfe, III, 818 W. Main St., Windsor Pond, Plainfield, MA (US) 01070; Walter Timmons Cardwell, Jr., 15 Dawnwood Dr., Greenville, SC (US) 29615

( * ) Notice: Subject to any disclaimer, the term of this patent is extended or adjusted under 35 U.S.C. 154(b) by 512 days.

(21) Appl. No.: 11/219,047

(22) Filed: Sep. 1, 2005

(65) Prior Publication Data

US 2006/0283171 A1 Dec. 21, 2006

Related U.S. Application Data

(60) Provisional application No. 60/607,405, filed on Sep. 3, 2004.

(51) Int. Cl.
*F03H 1/00* (2006.01)

(52) U.S. Cl. ..... 60/202; 313/359.1; 313/362.1

(58) Field of Classification Search ..... 60/202; 313/359.1, 362.1

See application file for complete search history.

(56) References Cited

U.S. PATENT DOCUMENTS

| | | | | |
|---|---|---|---|---|
| 2,949,550 | A | 8/1960 | Brown | |
| 3,018,394 | A | 1/1962 | Brown | |
| 3,022,430 | A | 2/1962 | Brown | |
| 3,071,705 | A | 1/1963 | Coleman et al. | |
| 3,119,233 | A * | 1/1964 | Wattendorf et al. | 60/202 |
| 3,120,363 | A | 2/1964 | Hagen | |
| 3,130,945 | A | 4/1964 | De Seversky | |
| 3,156,090 | A | 11/1964 | Kaufman | |
| 3,638,058 | A | 1/1972 | Fritzius | |
| 4,663,932 | A | 5/1987 | Cox | |
| 5,231,824 | A * | 8/1993 | Van Dick | 60/202 |
| 5,757,146 | A * | 5/1998 | Carder | 315/505 |
| 6,145,298 | A | 11/2000 | Burton, Jr. | |
| 6,449,941 | B1 * | 9/2002 | Warboys et al. | 60/202 |
| 2003/0205043 | A1 * | 11/2003 | Ward | 60/232 |
| 2004/0161332 | A1 | 8/2004 | Rabinowitz et al. | |

FOREIGN PATENT DOCUMENTS

| | | |
|---|---|---|
| WO | WO 98/19817 | 5/1998 |

* cited by examiner

*Primary Examiner*—Michael Cuff
*Assistant Examiner*—Phutthiwat Wongwian
(74) *Attorney, Agent, or Firm*—McCormick, Paulding & Huber LLP

(57) ABSTRACT

Several methods of increasing the thrust and energy efficiency of charged particle jet engines operating in a gaseous or liquid medium have been developed. We identify the three main components of charged particle thrust generation and show how to take maximum advantage of each. We also describe several structures and techniques to reduce the energy associated with the generation of charged particles and to minimize the number of charged particles needed to further increase energy efficiency. In addition to the structures and techniques used to increase thrust and energy efficiency, we have also developed several structures and techniques for efficiently controlling the amount and direction of thrust. Finally, we show many uses of these charged particle jet engines and ways to control them.

41 Claims, 25 Drawing Sheets

CHARGED PARTICLE THRUST ENGINE

CROSS REFERENCE TO RELATED APPLICATIONS

This application claims the benefit of U.S. Provisional Application Ser. No. 60/607,405, filed on Sep. 3, 2004, which is hereby incorporated by reference in its entirety.

BACKGROUND OF THE INVENTION

1. Field of the Invention

The field of the invention, charged particle jet engines, have been around in the form of ion jet engines for over fifty years and have been used as propulsion devices for very low thrust space applications. Attempts have been made to create an ion jet engine for use in the atmosphere using ions created out of the atmosphere itself. These attempts in the atmosphere have to date been unsuccessful in that the very low thrust produced required such high power input that other forms of propulsion have been shown to be far more efficient.

The reason for the very poor efficiency and low thrust is that until the present invention described here, the majority of the energy used to generate thrust was wasted in the creation of charged particles and by the inefficient method used to transfer energy from the accelerated charged particles to the neutral reaction mass molecules due to the interaction of the mean free path and the space charge generated reverse electric field.

2. Descriptions of Related Prior Art

In an ion engine, thrust is produced by ionizing neutral atoms or molecules and accelerating these ions, the reaction mass, by an electric field. The amount of thrust is equal to the reaction mass times the acceleration of that mass or the reaction mass times the change in velocity of the mass. To change the velocity of the reaction mass, energy must be supplied to that mass. The energy that must be supplied is equal to one half the mass times the change in velocity of the mass squared. Maximum energy efficiency is obtained by creating the greatest thrust for the least amount of supplied energy. Energy efficiency can be maximized by accelerating the largest reaction mass possible to the minimum velocity necessary to achieve the desired thrust.

In space applications, especially where energy can be obtained from solar energy or nuclear sources, the reaction mass must be minimized since it must be carried by the spacecraft itself. In this situation you want to accelerate the smallest mass to the highest velocity possible. You are minimizing the expenditure of mass by using relatively large amounts of energy. The overall energy efficiency of ion engines is very low when mass is being minimized but the thrust per unit mass is very high. Because the amount being accelerated is so small, most ion engines are only able to generate a few ounces of thrust at most. Still, in space applications where reaction mass is limited, they can be far more efficient than conventional rockets.

When an ion engine travels through a liquid or gaseous medium where the reaction mass does not have to be carried, it then becomes possible to maximize energy efficiency by accelerating the maximum amount of the medium possible. There have been attempts to build ion jets that operate in the atmosphere but to date these devices have produced only exceedingly small amounts of thrust very inefficiently because of a lack of understanding about how these devices really work.

With minor variations, these attempts consisted of two electrodes, the first either a thin wire supported over the second electrode that is either a flat plate aligned with the wire so that the thin edge of the plate is pointed toward the wire as in FIG. 1A or as a grid as shown in FIG. 1B, or the first electrode is a sharp point coaxial to a second ring electrode spaced at some distance from the first electrode as shown in FIG. 1C. A high voltage is then applied between the two electrodes and if the device is light enough and the voltage is sufficient, it will rise off the ground.

While the use of accelerated charged particles to create thrust goes all the way back to Robert Goddard in 1906, Konstantin Tsiolkovsky in 1911, and Herman Oberth in 1929, the first person to conduct experiments in electrostatic propulsion in air was Thomas Towsend Brown in the 1950's and early 1960's. His patents describe the use of two electrodes to both ionize and then accelerate the ions between the two electrodes to produce thrust. Because he was not clear and did not seem to recognize and express in these patents the mechanism whereby thrust was produced, later researchers developed two theories to explain the lifting force on these devices. The first is based on the work of Thomas Towsend Brown and Dr. Paul Alfred Biefeld usually referred to as the Biefield-Brown effect which has become associated with a theory that this lifting force is due to an as yet unknown interaction between an asymmetrical electrical field produced by an "asymmetrical capacitor" and either a gravitational field or some hypothetical unknown field or medium in space. The second explanation is that these devices create ions that are accelerated thereby producing thrust. Recent experiments performed in a vacuum have shown the second explanation to be the correct one and that contrary to the many patents issued using asymmetrical capacitors, the force based on this interpretation of the Biefield-Brown effect simply does not exist.

Part of the confusion occurs because the number of ions created and the accelerations they undergo based on the voltage and current between the two electrodes is too small to account for the thrust produced. When the additional mass of neutral air molecules accelerated by collisions with the accelerated ions is considered, the observed thrust is fully accounted for.

Also in the late 1950's and early 1960's, Glen E. Hagen developed an improvement on what has become known as a "Lifter" that is similar to the device of T. T. Brown in that it also used two electrodes to both create the ions and then accelerate them. Glen E. Hagen seems to be the first to realize that energy efficiency increases when more mass is accelerated at a lower velocity. His improvements consisted of maximizing the amount of mass accelerated by increasing the area of the electrodes. Alexander P. De Seversky used this same basic structure in his "Ionocraft" as did W. J. Coleman et al.

In the early 1970's, Robert S. Fritzius combined two pairs of electrodes of opposite polarity so that once the ions were accelerated, they would neutralize each other. In the late 1990's, Kenneth E. Burton took the basic Coleman device and reversed the polarity of the electrodes so that negative ions were created instead of positive ions.

In all known applications of ion thrusters in the atmosphere, they are all based on an ionizing electrode (5) in all drawings, either a sharp point FIG. 1C (5) or a thin wire FIG. 1A (5) and FIG. 1B (5), separated from an accelerating electrode (4) of either a plate, grid, or ring. The high voltage (8) applied between the two electrodes (3,4) both ionizes and accelerates the ions. While these devices will lift an ounce or two in air, attempts to increase the thrust to useable amounts have so far failed due to the lack of understanding of how to maximize the thrust while minimizing the energy required to generate that thrust.

BRIEF SUMMARY OF THE INVENTION

All reaction motors operate using Newton's third law of motion, for every action there is an equal but opposite reaction. This is simply a statement of the law of conservation of momentum. Momentum is the mass of an object times its velocity. A reaction motor works by accelerating a reaction mass, increasing its momentum that must be matched by an opposite change in momentum of reaction motor. We can accelerate the reaction mass by applying a force between the reaction motor and the reaction mass. This force is the thrust of the motor.

The energy of an object is one half its mass times its velocity squared. When we change the velocity of both the reaction mass and the reaction motor, we must supply energy to both. The power we must supply is the energy per unit time and is equal to one half the reaction mass flow rate times its velocity squared. We define the thrust efficiency as the thrust divided by the power added to the reaction mass to produce that thrust. The thrust efficiency is equal to two divided by the change in velocity of the reaction mass.

The thrust of a charged particle engine is equal to the force on each charged particle, which is equal to the charge on that particle times the instantaneous electric field at each point. The change in momentum of the charged particle is equal to that force times the time the force is applied to the particle. The equal and opposite force on the electrodes is the reaction motor thrust.

As the charged particles are accelerated in the electrostatic field, their velocity, momentum, and energy increases until they either leave the electrostatic field if they are operating in a vacuum or collide with a neutral molecule if they are operating in some medium. The thrust efficiency of a charged particle engine is two divided by the final velocity of the charged particles when it leaves the electric field.

The critical insight leading to the key features of this invention and what distinguishes it from the prior art is the recognition that, when operating in a medium, the efficiency of the charged particle engine is determined by the velocity of the charged particles at the time of their collision with the neutral molecules of the medium. Ion rockets in space, operating in a vacuum, accelerate the ions to a very high velocity which results in more thrust for a given reaction mass but with extremely low thrust efficiency. In a medium, the charged particles obtain much lower velocities because they are constantly being slowed by collisions with the medium. The key to thrust efficiency in a medium is finding ways to slow the velocity of the charged particles at the time of each collision.

In any gas, liquid, or solid, there is space between the atoms and molecules. This space is called the mean free path and is a function of the temperature and pressure of the material. It is the distance a particle will travel before colliding with another particle of the medium. In our case, when a charged particle is being accelerated by the electric field, the mean free path determines how far a charged particle will travel before colliding with another particle. If the mean free path is short, the charged particle will not acquire very much energy before colliding with the neutral molecule of the medium. The greater the mean free path, the higher will be the charged particle's velocity and thus the lower its efficiency when it collides with the molecules of the medium.

In theory, we could get any thrust we wanted at any thrust efficiency we wanted by simply using a larger number of charged particles accelerated at a lower voltage. Unfortunately, there is the problem of the natural mutual repulsion of the charged particles, which lowers the electrostatic field at the inlet electrode causing a limit on the number of charges that can be between the electrodes for a given voltage. To get sufficient charges for the required thrust results in very low thrust efficiency. It is the combination of this "space charge limited current" and the relatively large mean free path that results in very low thrust efficiency.

Our invention deals with the many steps that can be taken to increase both thrust and thrust efficiency of charged particle engines operating and a medium. In addition, we discuss efficient means of generating charged particles, for use in these engines, various applications of these engines, and methods of controlling these engines, and the applications that use them.

BRIEF DESCRIPTION OF THE DRAWINGS

The drawings contained herein illustrate to those skilled in the art the preferred embodiments of the invention. These drawings are merely a guide to aid in understanding the present invention.

DESCRIPTION OF THE PREFERRED EMBODIMENTS OF THE INVENTION

Figure 1A:
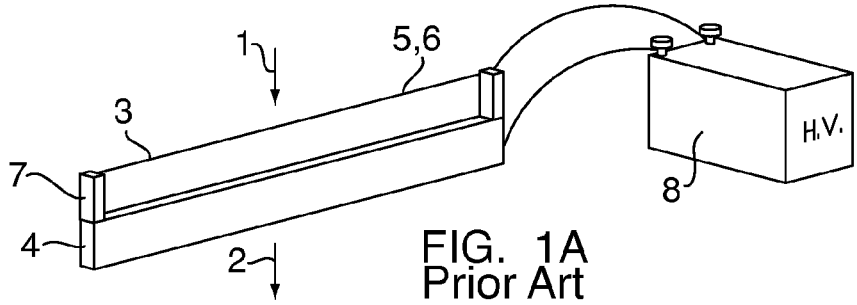
FIG. 1A Prior Art
FIG. 1 consists of three simplified drawings of the structures used in the prior art.
Figure 1B:
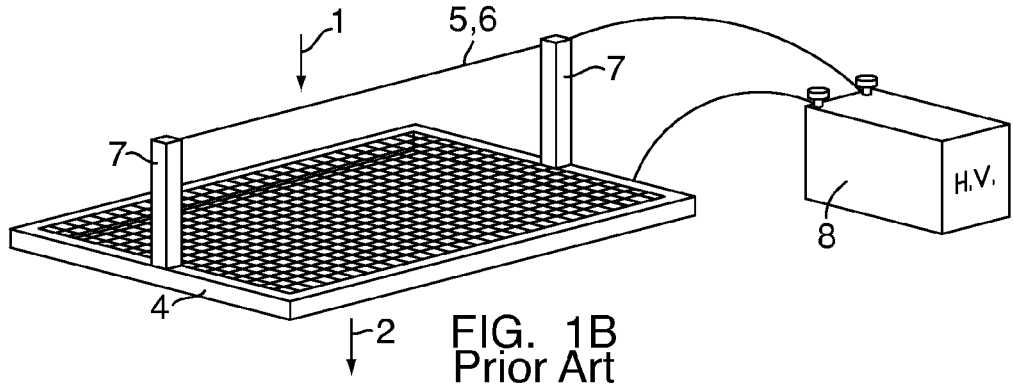
FIG. 1B Prior Art
Figure 1C:
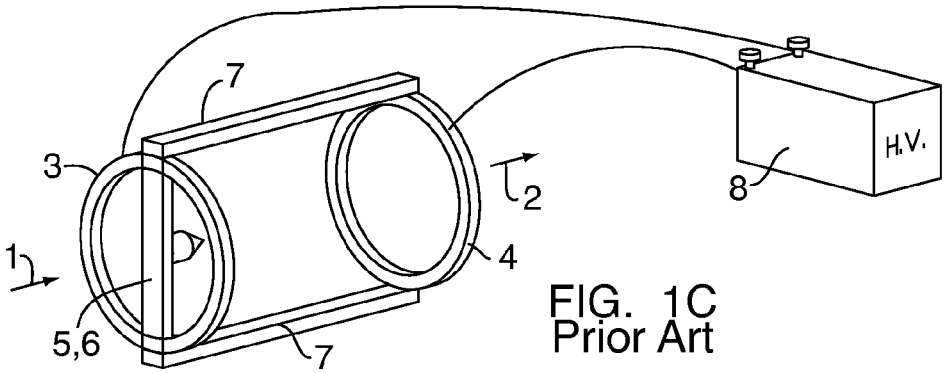
FIG. 1C Prior Art
Figure 1D:
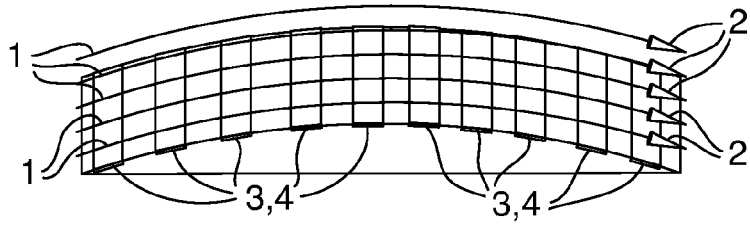
FIG. 1D Prior Art

For all reaction motors that rely on Newton's second law of motion, the following equations are universal.

$$F = ma, \tag{1a}$$

$$F = m\frac{dv}{dt}, \tag{1b}$$

$$Fdt = mdv, \tag{1c}$$

where:

F=the force on the mass, m=the mass being accelerated, a=the acceleration of the mass m dv=the instantaneous change in reaction mass velocity, dt=the time differential.

The change in momentum is mdv. The energy that must be added to the reaction mass, dϵ, is equal to:

$$d\varepsilon = \frac{1}{2}mdv^2 \tag{1d}$$

The power is simply the energy per unit time, $$P = \frac{d\varepsilon}{t} \tag{1e}$$

and is equal to:

$$P = \frac{1}{2}mdv^2 \tag{1f}$$

where, m=the mass flow rate.

We can define a thrust efficiency, $\eta_t$ equal to the thrust divided by the power, $$\eta_t = \frac{F}{P}. \tag{1g}$$

and is equal to, $$\eta_t = \frac{2}{\Delta v}. \tag{1h}$$

As we can see, efficiency is inversely proportional to the change in velocity of the reaction mass.

The critical insight leading to the key features of this invention and what distinguishes it from the prior art is the recognition that electrostatic thrust is totally determined by the charged particles while they are in the electric field and that the thrust efficiency is totally determined by their velocity at the time of their collision with the neutral reaction mass. The force on each charged particle is equal to the charge times the instantaneous electric field at each point. The change in momentum of the charged particle is still equal to the force times the time the force is applied to the particle, equation (1c). There is an equal and opposite force on the electrodes which produces the thrust. The thrust produces a change in momentum of the engine equal to but opposite in direction to the momentum of the charged particles. The velocity of the charged particle at the time of the collision with the neutral reaction mass is still the energy of the charged particle given by equation (1d). The energy given to a particle between collisions is equal to the charge times the electrical potential of the particle just after the previous collision and the electrical potential just at the point of the next collision.

This leads to fact that if we had 100% transfer of the energy and momentum of the charged particles to the neutral reaction mass molecules, the efficiency is fixed by equation (1h) at the time of the collision of the charged particle and the neutral reaction mass and it is 2 divided by the change in the velocity of the charged particle at the point of the collision that determines the efficiency not the velocity of the reaction mass. Because there is no interaction between the neutral molecules and the electric field, to a first approximation, whatever happens to the energy and momentum transferred to the neutral molecules after the collision does not affect the momentum or energy produced by the electric field.

In any gas, liquid, or solid, there is space between the atoms and molecules. This space is called the mean free path and is a function of the temperature and pressure of the material. It is the distance a particle will travel before colliding with another particle of the medium. In our case, when a charged particle is being accelerated by the electric field, the mean free path determines how far a charged particle will travel before colliding with another particle. If the mean free path is short, the charged particle will not acquire very much energy before colliding with the neutral reaction mass molecule. The greater the mean free path, the higher will be the charged particle's velocity and thus the lower its efficiency when it collides with the neutral reaction mass molecule.

We know that the best efficiency we can get from a reaction rocket is given by equation (1h). If we could arrange for each neutral particle to be hit only once by a charged particle and that this charged particle's velocity was always equal to the required velocity of the reaction mass needed to produce the required thrust, our charged particles would use the same energy as the neutral reaction mass requires and we would have 100% charged particle energy to reaction mass energy transfer.

In theory, we could obtain this optimum energy transfer by controlling the applied acceleration voltage so that at the time of each collision the velocity of the charged particles equals the required velocity of the neutral reaction mass. We would then only need to see that sufficient charged particles were used so that each neutral molecule collides with a charged particle and thus is accelerated to the final velocity.

The problem is the reverse electric field generated by the charged particles traveling between the electrodes. When the number of charges is great enough, this reverse electric field can completely cancel the applied electric field at the inlet electrode. To compensate for this low electric field, the applied voltage must be increased to the point that by the time you are able to get enough thrust the ion velocity has become so great at the exit electrode due to the relatively large mean free path, that the overall transfer efficiency is only a fraction of a percent.

The electrostatic thrust and efficiency is determined by the mean free path. At the inlet electrode, the mean free path is the same in all directions. As the neutral air mass' velocity increases, the mean free path in the direction of the particle acceleration increases. We could calculate the total thrust and efficiency by using a mean free path that varies with direction but it is easier to look at the electrostatic thrust produced as if it had two separate components. The component of thrust due to the equal mean free path we call the mobility thrust as the thrust is determined by the mobility of the charged particles in the reaction thrust medium. The component of thrust due to the increase in the mean free path as the reaction mass is accelerated we call the effective mass thrust. The effective mass energy transfer efficiency can approach 100% even with the space charge induced reverse electric field. The mobility thrust efficiency when the reverse electric field is included is usually less that 1%. It is the mobility thrust component that is most severely affected by the reverse electric field because the rather large mean free path allows the charged particles to attain high velocities when the applied acceleration voltage is increased to compensate for the reverse electric field.

When the velocity of the charged particle exceeds the average velocity required by the reaction mass for a given thrust, the charged particle transfers an excess amount of energy and momentum at each collision and while the momentum is then shared by collisions between the neutral molecules themselves, the excess energy after many collisions simply raises the temperature of the reaction mass. This lost "thermodynamic" energy can be partially recovered or partially turned into thermodynamic thrust or both.

From this understanding of the thrust and efficiency components of ion jets operating in either a gaseous or liquid medium, it is clear why previous attempts have failed. Because all previous attempts have utilized corona discharges between the two accelerating electrodes, where one electrode is the ion producing corona discharge electrode and the other electrode is the exit electrode where the ions are neutralized, the voltage applied to these electrodes is close to the maximum voltage that can be applied before breakdown of the air occurs which results in the highest charged particle velocity and thus the lowest efficiency possible, less than 1%.

The following methods for increasing thrust and/or efficiency can be implemented independently of each other.

It is clear that the first step in generating efficient electrostatic thrust is to decouple ion generation from ion acceleration. This allows us to control the accelerating voltage and thus the efficiency independently of the voltage needed for ion generation.

Because the mobility generated thrust is the most inefficient, any thing that increases that efficiency helps. The equations describing the thrust and efficiency of the mobility component of the electrostatic thrust are, $$F = \frac{9}{8}\varepsilon_o A \frac{v^2}{L^2} \tag{2a}$$

and $$\eta_t = \frac{L}{\mu V}. \tag{2b}$$

where,

F=the thrust in Newtons,

V=the accelerating potential in volts,

L=the electrode spacing in meters,

μ=the charged particle mobility in meters 2/volt seconds, $\epsilon_0$=the permitivity of free space in Farads/meter, and, $\eta_t$=the thrust efficiency in Newtons/Watt.

For parallel plate electrodes, the quantity V/L is the applied electric field strength and from equation (2b), reducing this term linearly increases efficiency but reduces thrust as the square of the electric field reduction. But we can increase efficiency by decreasing the mobility. The mobility is inversely proportional to the pressure of the medium so we can increase efficiency by converting the acquired velocity of the reaction mass as it passes through the engine to a pressure increase by enclosing the electrodes in a non conducting tube and slowly decrease the cross sectional area of the tube from inlet to exhaust to increase the pressure accordingly.

The greatest improvement in efficiency comes from reducing the reverse space charge induced electric field. If there were no reverse electric field, equation (2a) would vary linearly with the mobility and applied electric field. While in theory, the reverse electric field is a function of the physical properties of the charges and empty space, the reverse electric field in one direction can be modified by changing the change in the electric field in another direction. Poisson's equation in cylindrical coordinates is given by, $$\frac{1}{r}\frac{\partial}{\partial r}\left(r\frac{\partial V}{\partial r}\right) + \frac{1}{r_2}\left(\frac{\partial^2 V}{\partial \phi^2}\right) + \frac{\partial^2 V}{\partial z^2} = -\frac{P}{\varepsilon_0}. \tag{3}$$

This says that the sum of the changes in the radial, angular, and axial components of the space charge generated electric field are all equal to the space charge density divided by the permitivity of free space. Actually in a medium other than air, which has a relative permitivity of 1, it is the relative permitivity of the medium times the permitivity of free space.

There are many methods to alter the change in electric field strength in the radial and angular directions to lower the change in the electric field in the axial direction, the direction that generates the reverse electric field that opposes the applied accelerating electric field. The first method used to alter the radial and/or angular electric field strengths is to change the shape of the electrodes to create complex three dimensional electric fields were the radial and angular changes in the electric field are enhanced at the expense of the axial electric field. The second method is to use a non-uniform radial and/or angular charged particle density so that the self-induced radial and/or angular change in the electric field reduces the change in the axial electric field strength. A third method is to use additional electrodes between the accelerating electrodes to create a radial and/or angular component of the electric field. These electrodes can be insulated if necessary to prevent neutralization of the charged particles. A fourth method is to employ current carrying insulated regions imbedded in the region between the accelerating electrodes carrying oppositely charged particles whose space charge generated electric field completely or partially cancels the reverse electric field of the thrust producing charged particles. These oppositely charged regions could be charged particles producing thrust just of opposite sign or they could be non thrust producing charged particles such as electrons the eventually neutralize the thrust producing charged particles. A fifth method is to make these oppositely charged regions coaxial.

Another method to increase thrust and/or efficiency is to segment the engine. Here multiple electrodes are used to create the equivalent of several engines in tandem with charged particles fed mainly to the first electrode and where the potential of each succeeding electrode increases so that the charged particles are moved through all the stages. These intermediate electrodes could either be insulated or additional charged particles could be injected to replace those particles neutralized passing through the intermediate electrodes. The intermediate electrode could also be looked at as fixed potential surfaces that counteract the reverse electric field generated by the space charge. In any case the thrust is increased by the number of stages used, while the efficiency can be increased by reducing the applied voltage between each segment.

Another method to increase thrust and efficiency is to increase the charged particle current while reducing the applied voltage. The only way to do this without changing the mobility or density of the medium is to increase the number of charged particles that make up the charged particle current. Unfortunately, increasing the number of charges between the accelerating electrodes increases the reverse space charge until the point where they prevent any additional charged particles from entering the inlet region. If any additional charged particles enter the region, the reverse electric field becomes greater than the applied electric field and the charged particles are forced away from the inlet. We can, however, use a diffusion current to create a charged particle current flow against this reverse electric field.

The current that flows due to an electric field is called the drift current. A diffusion current is caused by any concentration gradient. The diffusion current is independent of the drift current and can actually flow in the opposite direction from the drift current. If we increase the charged particle concentration gradient at the inlet electrode, we can create a diffusion current that will flow against the space charge generated reverse electric field. The diffusion current is equal to a diffusion coefficient times the concentration gradient. The charged particles in this high concentration gradient region also generate an electric field and the magnitude of this electric field must be kept below the breakdown electric field of the medium. Even though the diffusion coefficient is usually and order of magnitude less than the mobility to which it is related, the concentration gradient can be quite high so that the diffusion current can actually be more than an order of magnitude greater than the space charge limited drift current.

It is also possible to use this concentration gradient with the segmented engine and where the high concentration gradient is propagated between the stages. The diffusion current will oppose the reverse drift current and eventually the diffusion current will reach a positive net acceleration voltage between the electrodes. At this point, the drift and diffusion currents will be in the same direction. When the end of a segment is reached, there will again be a net electric field opposing the charged particle current flow. The charged particles from the first stage will concentrate at the inlet of the second stage until the diffusion current associated with this concentration gradient counteracts the reverse drift current of this next stage. The result of this is the propagation of the concentration gradient through the stages of the engine.

To generate the concentration gradient at the inlet of the engine, either a physical barrier or an electrical one can be used to create the charged particle concentration gradient. If we pump charged particles into the inlet region and if we prevent them from escaping out the front of the engine, they will build up in concentration until they do flow into the engine. An insulated physical barrier can be used or a cap electrode can be used that creates an electric field that prevents the charged particles from escaping.

We have stated above that the excess energy of the charged particles is transferred to the neutral air mass in the form of heat. If the mobility thrust generation is only 1% efficient, then 99% of the energy is being used to heat the reaction mass. Some of this energy can either be recovered or converted into thrust or both.

The increase in temperature as the reaction mass is being accelerated through the engine results in the thermal motion of the neutral mass being greater at the exhaust than the intake. Because the thermal velocity is in all directions, half the neutral molecules will have a component of this thermal velocity going from back to front. Because the thermal velocity at the exit electrode is greater than the thermal velocity at the inlet, there will be a net flow of charged particles due to the different thermal velocities from exit to inlet. When these neutral molecules collide with a charged particle, the momentum associated with this velocity component is transferred back to the charged particle causing the charged particle to either not draw as much energy from the electric field or to return energy to the field.

Because the increase in thermal energy of the reaction mass raises its temperature and pressure, the thermodynamic energy can be converted into thrust exactly in the same way as it is converted in a conventional chemical jet engine. If the reaction mass can only leave through the exhaust, the pressure difference between the front of the engine and the rear of the engine will produce thrust. To convert this thermodynamic pressure into thrust, the engine must be enclosed whereby the neutral air mass is prevented from escaping except through the exhaust opening.

Most of the methods specified above will have some effect on the charged particle distribution and density. It is critical that if the effective mass component efficiency is not to rise as the charge particle density and distribution changes, that the neutral reaction mass density and distribution be altered to track the charged particle density and distribution as closely as possible. This can be accomplished by collisions with charged particles and/or by partitions, ducting and variable cross sectional areas within the accelerating region.

The basic structure of our charged particle jet engine device uses a plurality of electrodes connected to an electrical power source, at least one of said electrodes when immersed in a gaseous, liquid, or solid particle medium allows the medium to pass through or around it. The size, shape, and position of the electrodes and other structures in the medium create different regions of the medium used by the device. The introduction of low energy charged particles at any point in said medium or the separation of charged particles that are already in the medium assure that the majority of charged particles if any in a region are of one polarity. These charged particles are accelerated by one or more electric fields produced by potential differences between electrodes. The accelerated charged particles travel a sufficient distance in the medium so that the number of collisions of said accelerated charged particles with atoms and/or molecules of the medium result in the transfer of energy and momentum from the charged particles to the neutral atoms or molecules. The total mass of the neutral atoms and/or molecules that collide with the charged particles exceeds the total mass of the charged particles so that the energy and momentum of the neutral atoms and/or molecules that have collided with the accelerated charged particles exceeds the mass, energy and momentum of the accelerated charged particles after leaving the region of the device where the charged particles were accelerated and where the charged particles that are used to transfer energy and momentum to the neutral atoms and/or molecules to produce thrust are not created by high voltage ionization due to the electric fields of any of the accelerating electrodes.

One or more of the electrodes surrounds a given region in the medium and is of any size and shape and is immersed either partially or completely in the medium. One or more of the electrodes is made of a non insulating material or is covered totally or partially by an insulating material which allows the medium and any charged particles in the medium to pass through or around it. When one or more of the electrodes allows the charged particles to pass through or around the electrode some or all of the charged particles remain charged.

The area enclosed by one or more electrodes can be fixed or variable. One or more of the electrodes neutralizes some or all of the charged particles passing through or around the electrode. The electrodes can be held together and supported by a series of structures insulated from at least one electrode wherein such structure is of sufficient strength to withstand the mechanical and electrostatic forces placed on it and on any material or structure attached to it.

The structures can be rigid and/or adjustable such that both the spacing and orientation of the electrodes with respect to each other can be adjusted. The method used to adjust the structures can be mechanical, electrical or hydraulic. It is possible with the invention to transfer the thrust, momentum, energy, and motion of the structure to another structure of sufficient strength to withstand the mechanical and electrostatic forces placed on it and on any material or structure attached to it or to incorporate or merge the charged particle jet engine structures into another structure of sufficient strength.

The invention can be constructed so that one or more structures through which the medium cannot flow are used to control and direct the medium flow. The structures can partially enclose one or more regions of the medium forcing the medium to flow into and out of these regions through openings in the structure.

In the charged particle jet engine device the axial space charge generated electric field can be reduced using a nonuniform electric field perpendicular to the axial space charge generated electric field which can be a radial electric field, an angular space charge generated electric field or a nonuniform charge density. One method used to reduce the axial space charge generated electric field can consist of one or more additional electrodes, conductors, and channels any of which can be insulated or not and which can be axial, radial, and/or angular electrodes, conductors, and/or channels.

A second method used to reduce the axial space charge generated electric field consists of one or more adjacent or coaxial axial thrust producing regions wherein the charged particles are of a polarity where the space charge generated electric fields of all of the regions can be made to partially or completely cancel the space charge generated electric fields of each of the regions.

The space charge limited current flow can be increased through the use of a diffusion current wherein the greater the concentration gradient of the charged particles, the greater will be the diffusion current and therefore the space charged limited current. Two methods of increasing the concentration gradient of the charged particles are through the use of one or more additional closely spaced electrodes that create an electric field that concentrates the charged particles at the desired location and/or through the use of one or more insulated structures that form a physical barrier preventing the charged particles from leaving in all but the desired direction.

To increase the efficiency of the charged particle jet engine, we can recover some of the thermodynamic energy of the reaction mass through the interaction of high energy neutral atoms and/or molecules with charged particles in some region of the engine and we can maximize the energy recovery by concentrating charged particles in a region of interaction of the neutral atoms and/or molecules and the charged particles through the use of one or more additional electrodes and/or through the use of one or more structures that form a physical barrier preventing the charged particles from leaving in all but the desired direction.

We can also convert some of the thermodynamic energy to thrust by preventing the neutral reaction mass from flowing out the inlet of one or more of the thrust producing regions as thermodynamic energy is added to the reaction mass by changing the direction and/or velocity of the neutral atoms and/or molecules whereby the change in momentum of the neutral atoms and/or molecules must be matched by an equal but opposite change in momentum of the charged particle jet engine resulting in increasing the thrust of the engine. We prevent the neutral atoms and/or molecules from flowing out the inlet of one or more of the thrust producing regions through the use of collisions of the neutral atoms and/or molecules with charged particles, or some structure of the charged particle engine itself. We can once again use one or more additional electrodes to concentrate the charged particles to maximize the number of neutral atoms and/or molecules that are prevented from leaving through the inlet of the one or more thrust producing regions. We can also prevent the neutral atoms and/or molecules from flowing out the inlet of one or more of the thrust producing regions through the use of increased pressure of the medium at the inlet to that region.

Charged particle jet engines can be combined in three ways to increase either thrust, efficiency, or both. Simply using multiple independent charged particle engines is one way but the input area, energy use, and weight increase linearly with the number of charged particle engines used. Placing two or more independent charged particle jet engines in tandem where the neutral reaction mass output of one charged particle jet engine is fed into the input of another charged particle jet engine will increase thrust, energy use, and weight linearly with the number of stages while the input area will remain constant. Placing two or more merged charged particle jet engines where the output electrode of one engine is the input electrode of the next charged particle jet engine produces a segmented charged particle jet engine where the thrust, energy, and weight increase linearly with the number of stages while the input area and the ion generation energy will remain constant. For the segmented configuration, each electrode in sequence must be at a higher electrical potential that the preceding electrode. For the tandem configuration, the electrode potentials can be independent of each other because no charged particles are transferred between charged particle jet engines.

For a charged particle jet engine to work, the charged particles must either be removed from the reaction mass or neutralized when they are no longer needed. Charged particles can be separated from the reaction mass by electromagnetic fields and once separated can be either stored, neutralized or recirculated. At the same time the particles are separated, they can be sorted by mass so that whether a charged particle is neutralized, stored, or recirculated can be based on the mass of the charged particle. The accelerating electrostatic field will cause the charged particles to be attracted to the exit electrode. If this electrode is made conductive, it will neutralize the charged particles. The charged particles can also be neutralized by injecting the opposite polarity charges from the ion generator into the region where the charged particles are to be neutralized or by letting the charged particles form opposite polarity thrust producing regions neutralize each other. If the charged particles are to be recirculated, electromagnetic forces can be used to direct and accelerate the recirculating charges. It is also possible to use a mechanical transport means such as a mechanical pump to recirculate the charged particles. If the charged particles are not created from the medium, it may be advantageous to first neutralize the charged particles and transport them to the input of a charged particle generator.

Because increasing the amount of mass being accelerated increases the thrust efficiency, we can also apply the following methods to increase the mass flow of the medium into one or more regions of the device. When the engine is moving with respect to the medium, a collecting scoop can be inserted into the medium to increase the amount of the medium that enters a region. We can also use an electrostatic or electromagnetic fields to produce a force on charged particles that collide with the neutral material of the medium and funnel extra material into the region.

We can increase the efficiency of the charged particle jet engine if we convert any velocity of the medium into a density increase as the thrust efficiency of charged particle jet engines increases with the density of the medium. We can use nozzles or other mechanical means to increase the density of the medium. Although they add weight, complexity, and moving parts, mechanical compressors can also be used to increase the density of the medium in various regions of the device. We can also use electrostatic or electromagnetic forces on charged particles that collide with the neutral material of the medium to increase the density of the medium.

We can produce vectored thrust in a charged particle jet engine by a variety of means. We can alter the trajectory of the charged particles to change the direction of the particle acceleration using one or more alternate accelerating electrodes and/or one or more segmented electrodes and either switching between the one or more alternate accelerating electrodes or electrode segments or by applying different accelerating potentials to one or more alternate accelerating electrodes and/or one or more electrode segments. We can also use the injection of a nonuniform charge particle density to provide a nonuniform energy transfer to the reaction mass to produce nonuniform-vectored thrust. We can alter the trajectory of both the charged particles and the neutral medium through the use of one or more moveable nozzles or through the use of a flexible material enclosing a region of the charged particle jet engine that can be adjusted to change the direction of the charged particles and the neutral medium. We can also use collisions of the charge particles whose trajectory can be changes through one or more of the methods outline above with the neutral particles to control the trajectory of both the charged particles and the neutral particles. The use of alternate electrodes can be used to select which region the neutral medium enters. We can also, of course, rotate the entire engine through some axis to produce vectored thrust. The electrical methods have the advantage of direct electrical control of the thrust trajectory and no moving parts.

In the charged particle jet engine of the present invention, the charged particles can be either created directly in the appropriate region through photon ionization and/or through electron or other particle collisions of sufficient energy. Corona discharge is a special case of particle collisions that uses a high electric field to produce a cascade of charged particles. The traditional use of corona discharge produced by a high electric field between the inlet and output accelerating electrodes guarantees the lowest efficiency possible as the charged particles, once they are created, are accelerated through the maximum potential possible for a given electrode spacing. Corona discharge can be used to create ions directly in a region at high efficiency if both of the electrodes producing the high electric field are not the same as both the inlet and output accelerating electrodes. In most cases, however, it will be more efficient obtain the charged particles outside of the accelerating region and then injecting them into the region. The source of these charged particles can be stored charged particles either created from some medium or particles that have a permanent static charge, charged particles created from a medium other than the medium accelerated by the charged particles, and/or from the same medium that the charged particles accelerate and form the neutral reaction mass. The charged particle generator can be an ion generator that uses a high electric field, electromagnetic radiation and/or particle collisions including corona discharge to generate ions using the minimum energy possible to create the ions. If excess energy is used in creating the charged particles, it can be recovered through the interaction of the charged particle and an electric field. Finally, it is possible that the medium itself can contain sufficient charged particles to produce the required thrust and by ensuring that in any region of the charged particle engine where the charged particles are used to supply energy to the neutral medium that the majority of the charged particles in the region have the same polarity either through separation or through selective neutralization.

In addition to controlling the direction of the thrust, it is usually necessary to control the amount of thrust produced. Thrust can be varied by varying the potentials applied to the accelerating electrodes, varying the quantity and/or distribution of the charged particles in a thrust producing region of the charged particle jet engine, varying the space charge generated reverse electric field by varying the potentials and/or currents of any space charge generated reverse electric field minimizing electrodes or conductors and/or by controlling the amount of neutral reaction mass that is available in a thrust producing region. The amount of neutral reaction mass available and/or the number of charged particles available in a region can be controlled by a mechanical throttle and/or by electrodes that direct some or all of the charged particles to a non thrust producing region of the charged particle ion engine and direct the neutral reaction mass particles to a non thrust producing region by collisions with charged particles.

There are a vast number of uses for the charged particle jet engine. The following uses are meant only to be a sample of the wide range of applications of the charged particle jet engine and are meant only to illustrate some of the many advantages of the charged particle jet engine over other means of producing thrust and are not intended in any way to limit the scope of this invention.

A charged particle jet engine of any size packaged as self contained unit containing one or more ion generators, one or more ion acceleration regions, a power source, a power supply, fuel, and control electronics will create a stand alone self contained source of a force that can be applied to any object where the application of such a force has meaning. The charged particle jet engine can also be integrated into the structures such as, but not limited to, vehicles and self contained unit above. Integrating the charged particle jet engine into some other structure can result is tremendous savings in materials, cost, and/or weight. For example, an enclosed charged particle jet engine could be integrated into the airframe of a jet aircraft where a single structural tube would provide the support for embedded accelerating electrodes, would at the same time provide a large area structural support for a fuel cell and/or a solar cell greatly reducing weight. The choice of fuel and power source would depend on the application but could be one or a combination of a battery, a solar cell, a fuel cell, and/or some form of a nuclear reactor.

The charged particle jet engine can be used as a means to move the medium in which it is embedded instead of moving itself. It can be used as a fan and/or pump that move a potentially unlimited volume of a gaseous medium such as air or other gas or a liquid such as water.

While the use of a charged particle jet engine to move a liquid or gaseous medium is useful, it is the application of one or more charged particle jet engines to a wide variety of objects to produce one or more forces on these objects that is especially useful. The one or more charged particle jet engines can be temporarily or permanently attached to the object and if permanently attached can be integrated into the objects structure. In most applications, the objects to which the one or more charged particle jet engines apply their force to will be partially or completely immersed in the reaction mass medium whether it is gaseous or liquid, air or water. We can define a set of orthogonal axis to fix the position and orientation of the object in space. If a gravitational force is detectable at the location of the object, the vertical axis is defined to be in the direction of the gravitational force. The other two orthogonal axis are at right angles to the vertical axis. If there is no detectable gravitational force, the orientations of the axis are arbitrary. These axis can be used to define the position, orientation, distance, and velocity of the object and the direction of the forces that are applied to the object. The charged particle jet engines can be aligned with the axis or not depending on the application.

The forces on the objects are not limited to forces produced by the charged particle jet engines but may also include the gravitational force, static forces such as those produced by wheels or static structures, fluid dynamic forces, buoyant forces, and forces due to inertia. The buoyant and fluid dynamic forces can be those produced by one or more gases and/or one or more liquids. The fluid dynamic forces can be produced or modified by one or more airfoils, one or more hydrofoils, and/or one or more control surfaces on the object where the control surfaces can be either fixed or moveable about any arbitrary axis not necessarily aligned with the global axis mentioned above. Additional fluid dynamic forces can occur at the interface between two different media such as planing on the surface of the medium by such objects as boats and skis, surface tension of the medium, and so the called "ground effect" forces. The total net force on the object can be modified in both magnitude and/or direction by modifying the magnitude and/or direction of any of the individual forces on the object. The magnitude and direction of the forces on the object produced by the one or more charged particle jet engines can be modified by any of the methods given above. The fluid dynamic forces can be modified by varying the velocity, shape, and/or orientation of the object in the medium or through one or more of the control surfaces. The surface forces can be modified by the object's velocity, shape, orientation with respect to the surface and distance from the surface. Buoyant forces can be modified by varying the size shape or weight of the object.

Through the modification of the forces on the object by one or more methods given above, the position, orientation, acceleration, size, shape, and/or velocity of the object can be modified. These parameters can be directly modified by a computer through direct electrical control of the forces on the object. The spacing and relative velocity of the object in relation to any known physical object, not just other charged particle jet engine controlled objects, can be modified and/or maintained by this computer control through sensors on the object or by some traffic control system that is in communication with the object. The fact that the object is under computer control does not prevent manual control from being exercised over the object, "fly by wire". The desired values of any of the parameters controlled by the computer can be entered into the computer and where the computer is connected to a sensor that determines the current value for the parameter, the computer can modify the actual parameter to match the desired value. This allows the parameters to be stabilized under varying conditions such as load, currents and eddies in the medium, and/or varying surface conditions.

One of the objects to which one or more charged particle jet engines can be attached is a person. Small engines can be attached to boots worn by the person where the thrust can appear as the same force one would experience standing on a solid surface. Alternately, a harness can be used to attach one or more the charged particle jet engines to the persons back or the engines can be attached to a flight suit where the force is applied to the body over a wide area. When attached to a person, the charged particle jet engine can function as a parachute. To add control and stability, additional small control charged particle jets can be attached to gloves so that a force can be exerted on the hands to maintain balance. The amount of force generated by the charged particle jet engines attached to the boots could be regulated by the angle of the ankle so that standing on your toes would increase thrust while standing on you heels would reduce thrust to zero. The same mechanism could be applied to the charged particle jet engines attached to the hands where the angle of the wrist controls the magnitude of the thrust.

We can constrain the motion of the objects to which the charged particle jet engines are attached through some guide structure where this guide structure can be in the form of a track that is partially surrounded by part of the object, a track structure that partially surrounds the object, a track structure that completely surrounds the object, a tube structure that partially surrounds the object, a tube structure that completely surrounds the object, a virtual path stored in a computer that uses onboard GPS information and/or an inertial guidance system to match the stored position and velocity with the actual position and velocity as determined by the inertial guidance system and/or the GPS signals, some structure that can be sensed by sensors on the object wherein the structure is either fixed or variable in time and/or space, or where the path consists of one or more electromagnetic signals such as focused light beams that can be sensed by the object's sensors. The constrained path can be defined by a trajectory between the current position of the object and a point in space fixed or variable with respect to time and position. This point is space can be a waypoint, a final or destination point, an other object in space where the object is either moving or stationary. A destination point is a final point where the object can remain without the expenditure of energy. The final point can be a target point where the constrained object can affect some other object at that point, the target object, by destroying it using the kinetic energy of the constrained object, by an explosive chemical or nuclear warhead detonated at or near the target point with the warhead having sufficient energy to destroy the target object. The target point can be the position of an object whose initial position at the target point can be altered by the constrained object attaching to the target object by magnetic, mechanical, or adhesive means and then using the forces applied to the constrained object to move both objects. If the target object is a charged particle jet engine controlled object by communication between the constrained object and the target object can be used to force the target object into a path that follows the constrained object. Multiple charged particle jet engine controlled objects can be constrained to follow the same path with a set separation maintained by a mechanical spacer or a sensor that senses the spacing between the objects and where the control mechanism uses the sensors to modify the actual spacing so that it equals the desired spacing thus forming a virtual train.

We reduce the dynamic friction on a surface of the charged particle jet engine in contact with a medium by covering the surface with charged particles to act as an elastic layer between medium and the surface. These charged particles can collect naturally at the surface containing charged particles due to the mutual repulsion of like charges from each other. The charged particles can be held against a surface using a potential applied to the surface insulated from the charged particles and one or more of the charged particles jet engines electrodes.

Figure 2A:
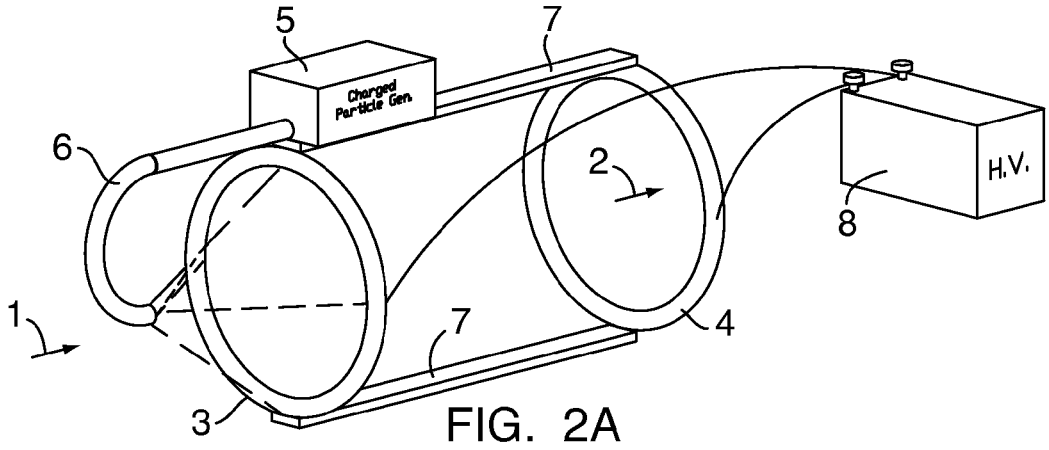
FIG. 2 consists of drawings of two views of the simplified invention along with an alternate charged particle source based on ionizing the atmosphere.

Referring to the drawings, FIG. 2A shows a schematic side view of the various components of this invention. In this Figure and throughout this document, (1) is an arrow indicating the entry point of the gaseous or liquid medium. The arrow labeled (2) points to the exit point of the medium. The rings, (3) and (4) are the electrodes used to create the electrostatic field that accelerates the charged particles in a direction from (3) to (4). The charged particle generator (5) is independent of the electrostatic force acceleration field between the two electrodes (3) and (4). The path (6) is used to introduce the charged particles uniformly into the field between the two accelerating electrodes and while this is shown schematically as a separate tube, this is not meant to rule out charge generation methods that are contained within one or more of the electrodes. What is ruled out is the sole use of the electrostatic field between the two accelerating electrodes to generate ions by corona discharge. The separation between electrodes is maintained by the insulated supports (7) while the power supply (8) provides the acceleration voltage applied to the two electrodes. The alternate charged particle generator shown in FIG. 2B creates ions from the medium as shown by the opening to the medium indicated by the medium input arrow (3) whereas the generators of FIG. 2A and FIG. 2C may or may not use ions from the medium as the charged particles.

When the charged particles have reached the exit electrode, they no longer contribute to the thrust of the engine and must be neutralized unless they are to be recirculated or used in stages that follow as discussed later in this document. Because all the charged particles are attracted to the exit electrode, they can be neutralized simply by making the electrode conductive on its surface where the charged particles can either pickup or lose their charge. Because the velocity of charged particles in a medium have been slowed by collisions with the medium, erosion of the electrodes should not be a significant problem.

Figure 3A:
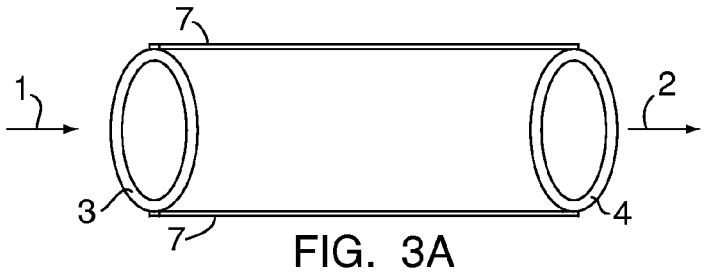
FIG. 3 shows alternate structures of the invention that can be used to optimize some aspect of the invention.

FIGS. 3 through 21 show various configurations of the invention that are presented to enhance understanding of the principles and flexibility of the invention and are not intended to limit in any way the scope of the invention. FIG. 3 illustrates various charged particle jet configurations that may offer certain advantages depending on the application. In these drawings, charged particle generation is omitted for clarity. In FIG. 3A, the basic open frame structure is shown. Here, the two electrodes (3) and (4) are separated by an insulator (7) and provide a medium input (1) and exhaust output (2). This configuration works due to the fact that the force is between the charged particles and the electrodes. When charged particles collide with neutral atoms and molecules, the amount and direction of the resulting energy transfer is random and that when averaged over many collisions results in 50% of the charged particle's energy being transferred in the direction of the rear electrode. The other 50% leaves perpendicular to the thrust axis in all directions and results in no net thrust. The advantage to this configuration is simplicity and light weight. The disadvantage is that the random thermodynamic energy cannot be converted into thrust.

Figure 3B:
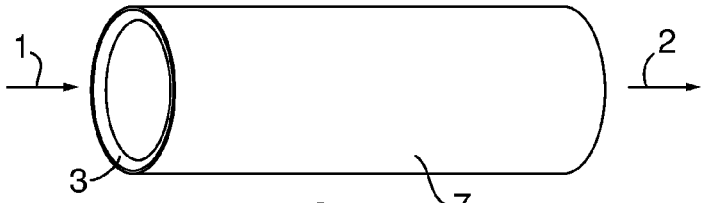

FIG. 3B encloses the electrodes in an insulating housing (7). Some of the lost energy of the open frame configuration can be recovered from the neutral atoms and molecules by constraining the perpendicular component of the neutral atom's and molecule's motion. This is possible because the charged particle jet engine like conventional jets and rockets also contains accelerated neutral atoms and molecules whose perpendicular energy component can be converted into an axial component through collisions with other atoms and molecules while contained between the electrodes. We discuss this further below when dealing with the lost thermodynamic energy.

Figure 3C:
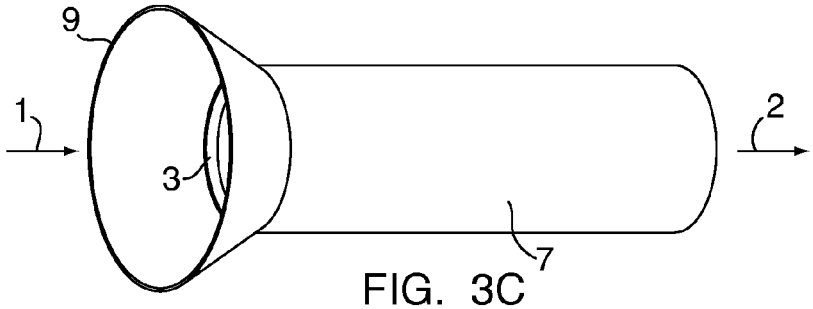

FIG. 3C shows the addition of a medium scoop or funnel (9) used to increase the number of neutral atoms and molecules entering the engine. The more mass that is moved, the less energy is needed for a given thrust.

Figure 3D:
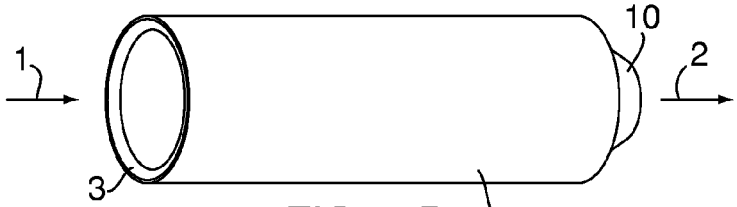
Figure 3E:
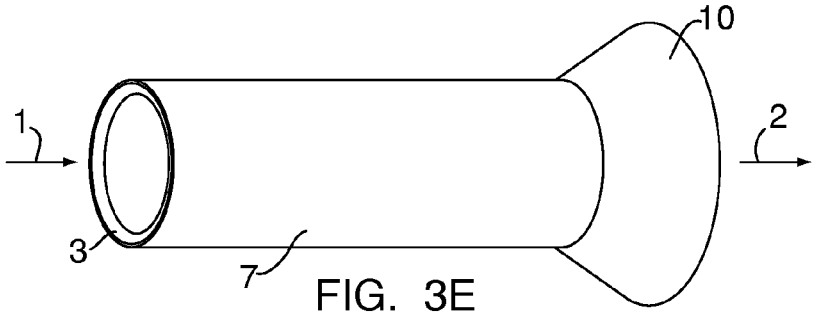

FIG. 3D shows a converging nozzle (10) that can be used to recover part of the energy of the neutral atoms and molecules. FIG. 3E shows a diverging nozzle (10) that can also be used to recover this energy.

Figure 3F:
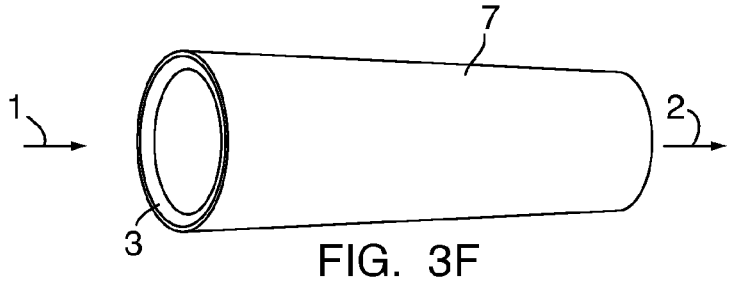
Figure 3G:
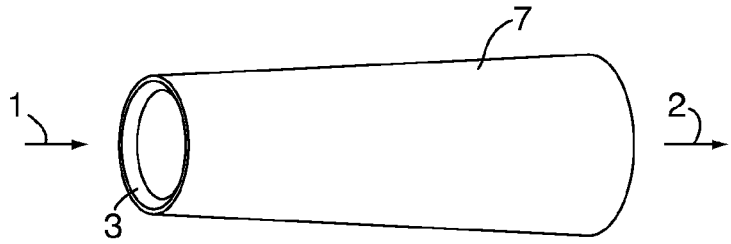

FIG. 3F shows a tapered configuration where the cross sectional area decreases going from the entry electrode to the exit electrode that results in an increase in pressure of the neutral atoms and molecules as they travel between the electrodes. FIG. 3G show a reverse taper where the pressure decreases from front to back over what it would be if the cross section were not tapered. The tapered walls also convert the perpendicular energy flow of the neutral atoms and molecules into axial thrust through collisions with the housing (7).

Figure 3H:
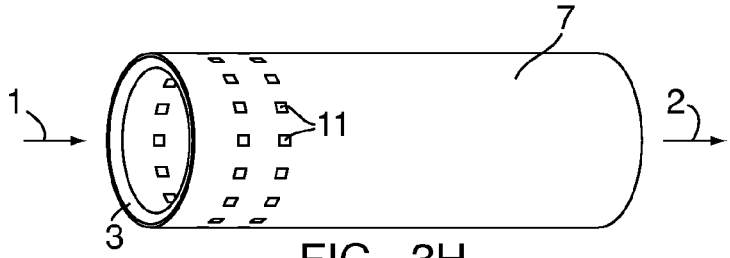
Figure 3I:
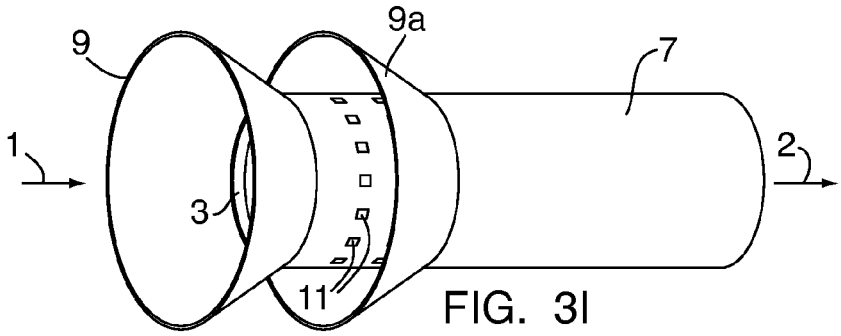

FIG. 3H shows the use of medium inlets (11) around the circumference of the housing used to bring more of the medium into the region between the electrodes. This is especially useful in applications where the electrodes are stationary with respect to the medium and where the purpose of the charged particle jet is to provide static thrust with no relative motion with respect to the medium. FIG. 3I shows an additional scoop or funnel (9*a*) designed to pressurize the air entering the peripheral air inlets. Flapper doors over the inlets can be made to close when the pressure inside the jet is greater than the pressure outside.

Figure 3J:
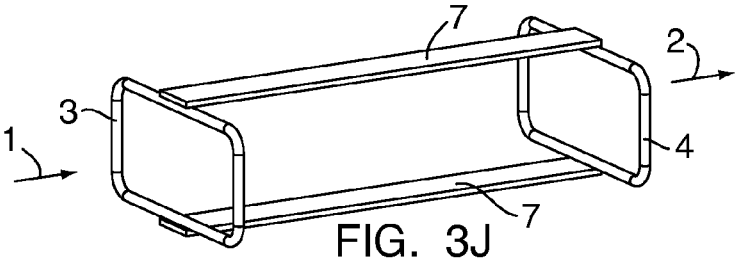
Figure 4A:
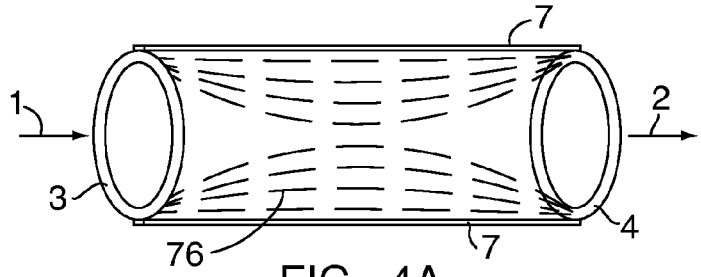
FIG. 4 shows several electrode configurations that can be used to create radial and angular components of the applied accelerating electric field.
Figure 4B:
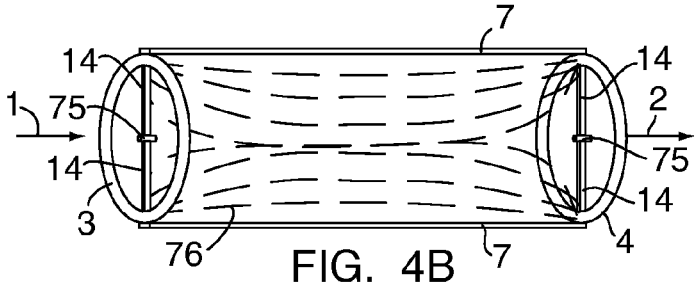
Figure 4C:
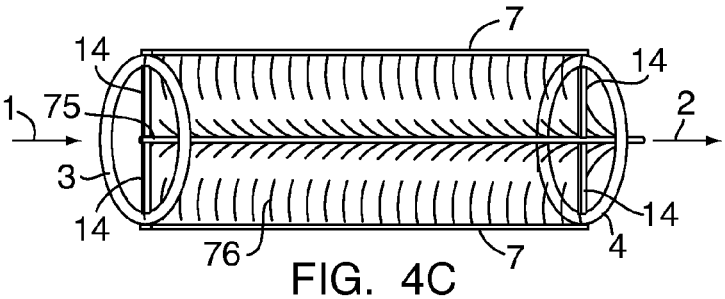
Figure 4D:
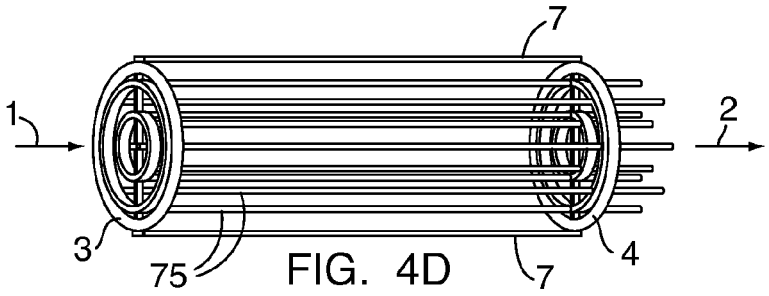
Figure 4E:
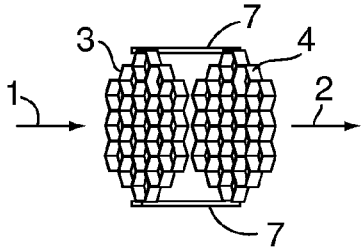

FIG. 3J shows an open frame configuration of the charged particle engine where the electrodes are not circular rings. In fact, the electrodes can be of any shape depending on the desired electric field distribution and the space constraints of the design. It should also be quite obvious that the modifications to the open frame structure of FIG. 3A shown in FIGS. 3B through FIG. 3I can also be applied to the open frame structure shown in FIG. 3J and other arbitrary electrode shapes.

The drawings of FIG. 4 and FIG. 5 all show methods used to reduce the axial space charge generated reverse electrostatic field. FIG. 4 shows open charged particle jet engines while FIG. 5 shows enclosed structures. FIG. 4A shows the standard open ring configuration of FIG. 3A with the applied electric field (76) shown. The use of large diameter electrodes without any mesh to spread the potential across the inlet and outlet allows the potential inside the ring area to vary and as a result will lead to the electric field shown. Where the field lines are not parallel to the electrode axis, a radial component of the electric field will exist. Just like in the case of the axial electric field, the charges in the region will also reduce the applied radial and angular electric field and because the sum of all the changes in the electric fields in all directions must equal the charge density divided by the permitivity, increasing the radial and angular change in the electric field results in a decrease in the axial space charge generated reverse electric field. FIG. 4B uses a small electrode (75) attached to each ring that can be operated at a lower potential than the ring electrodes to increase the radial electric field component causing a greater change in the radial electric field and thus a lower reverse axial electrostatic field. FIG. 4C uses axial electrodes to create a more uniform reverse radial electric field. While the electrode is shown going from the inlet electrode to past the exit electrode, it is clear that the length, diameter, and position, of the electrode can be varied to optimize the field for the particular application. FIG. 4D uses a plurality of electrodes whose individual potentials can be varied to achieve any desired electrostatic field configuration including a non-uniform angular as well and radial electric field component. FIG. 4E shows honeycomb electrodes, although they can be of any desired shape that can be used to divide up the overall input area into smaller radii regions to increase the change in the radial electric field strength.

In FIG. 5, enclosed charged particle engines are shown. FIG. 5A through FIG. 5E correspond to the open charged particle engines of FIG. 4A through FIG. 4E respectively. In the case of closed charged particle engines, the enclosing structure can also be used as an electrode to modify the radial and/or angular electric fields.

Figure 5A:
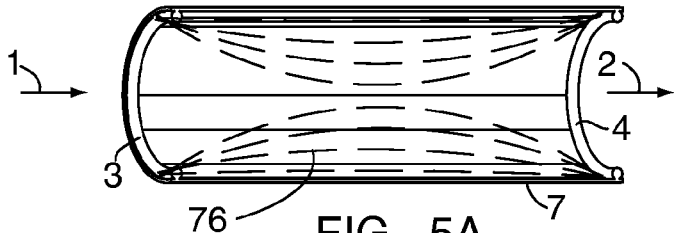
FIG. 5 shows various partitions, sectioning, ducting and variable cross sectional areas within the accelerating region to control neutral molecular flow.
Figure 5B:
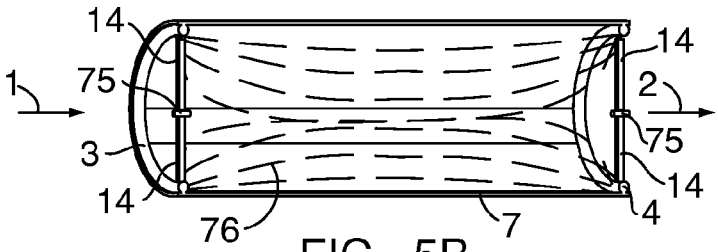
Figure 5C:
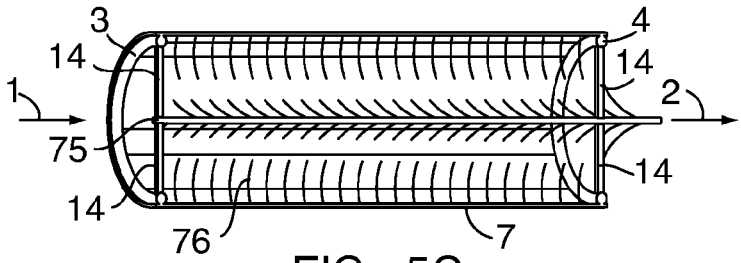
Figure 5D:
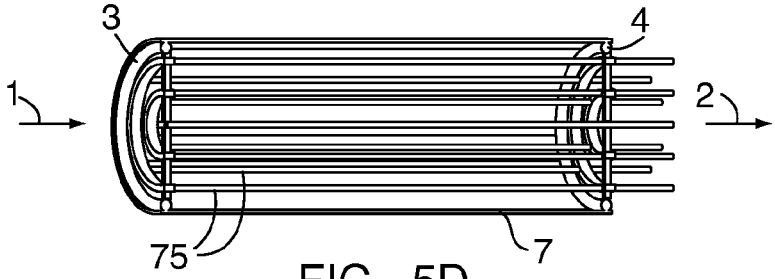
Figure 5E:
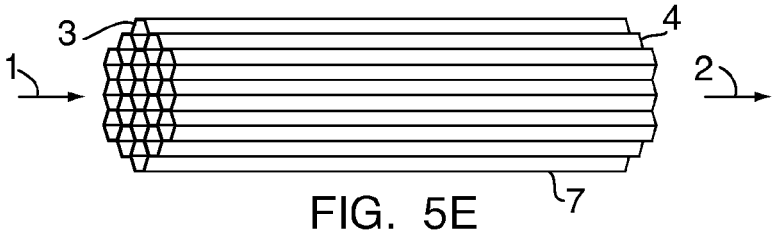
Figure 5F:
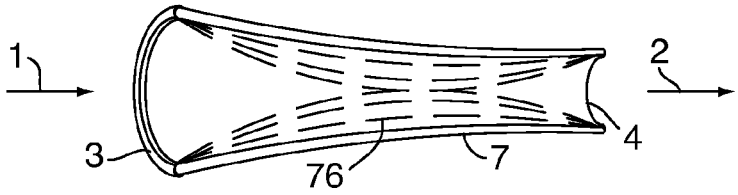
Figure 5G:
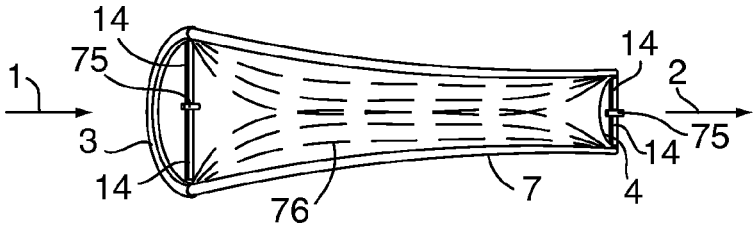
Figure 5H:
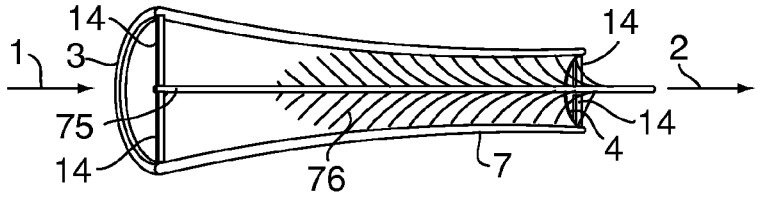

The introduction of radial and/or angular electric field components will result in non-uniform radial and/or angular charge densities. To maximize efficiency and thrust, the neutral medium density should track these changes. In FIG. 5F, the radial electric field will tend to concentrate the charged particles near the center axis. The tapered enclosure shown in FIG. 5F can be used to help concentrate the neutral molecules toward the center axis. FIG. 5G and FIG. 5H use additional electrodes corresponding to the additional electrodes of FIG. 5B and FIG. 5C respectively along with the tapered enclosure. It should be clear that the actual shape of the enclosure could be modified to control the path of the neutral medium.

Figure 5I:
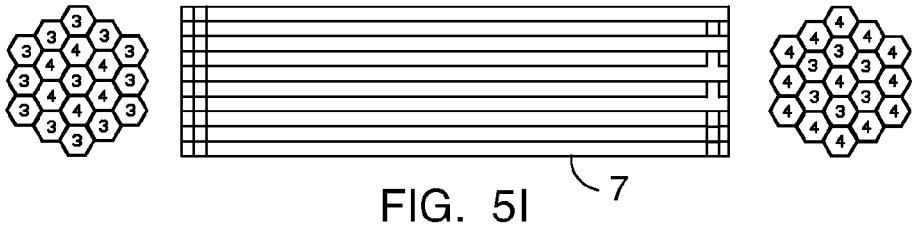
Figure 5J:
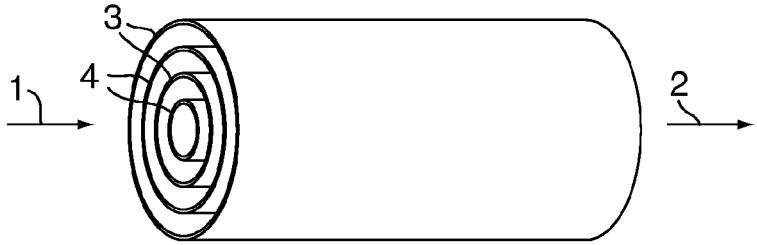

There is a second way to reduce the space charge generated reverse axial electric field and that is by using oppositely charged particles to cancel the effect of the charged particles producing the thrust. If FIG. 4C, FIG. 4D, FIG. 5C, FIG. 5D, and FIG. 5H, the axial electrodes can also be insulated conductors or conducting channels containing oppositely charged particles whose charge density matches the charge density of the charges producing the thrust. The charges in this region can simply be electrons or if it is a conductor or charged particles of opposite polarity if it is a hollow region. The point is to match the charge density at each point to partially cancel the reverse electric field of the particles producing the thrust. In FIG. 5I, the smaller radius sections produce thrust by using charged particles of both polarity intermixed to provide maximum cancellation of the reverse space charge electric field. The charge particle polarity of each section is shown by the electrode numbers at the front and rear, where the polarity of charges in the channels with the electrode marked (3) is opposite the polarity of channels with the electrode marked (4). In FIG. 5J, the regions of opposite charge polarity are coaxial.

In FIG. 6, we show various engine segmentation schemes. The reverse space charge electric field limits the number of charges that will enter the region between the electrodes. The greater the separation between the electrodes, the fewer charges will enter the region and the lower the thrust for a given applied voltage. It is possible to reduce the separation between electrodes and still maintain the same thrust by using additional intermediate electrodes (77) between the inlet (3) and outlet (4) electrodes. This is not the same as operating multiple independent charge particle engines in tandem because the electrical potential continues to rise from one electrode to the next because the outlet electrode of one segment is the input electrode of the next. In order to work, each electrode must be at a higher potential than the one that precedes it. It is not the fact that the charged particles are being reused that separates segmented operation from tandem operation, but the sharing of electrodes from one segment to the next. While it may not be necessary to inject new charged particles into the region near each electrode, this certainly can be done if necessary to replace charges lost or to tailor each segment to the velocity and density of the neutral reaction mass.

Figure 6A:
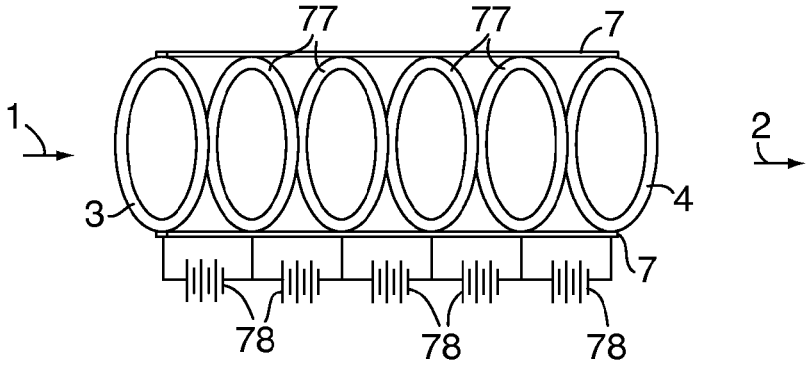
FIG. 6 shows the use of multiple segments to increase thrust and efficiency.
Figure 6B:
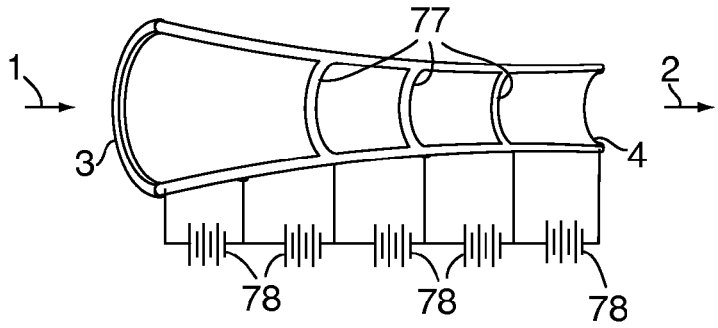

FIG. 6A shows multiple open electrodes (3), (4), and (77) with each electrode at a higher potential than the preceding electrode as shown by the multiple power supplies (78) in series. In FIG. 6B, we show an enclosed set of electrodes with the enclosure tapered to increase the charged particle and neutral reaction mass density from segment to segment.

FIG. 7 deals with another method of increasing the charged particles between the accelerating electrodes (3) and (4). When operating under space charge limited current conditions, the electric field at the inlet accelerating electrode (3) is reduced to zero by the space charge generated reverse electric field. If more charges somehow enter the regions between the electrodes, the electric field will actually reverse forcing charges out the front electrode ring. But we can force charges to move against this reverse electric field so that there will be a net charged particle flow into the inlet electrode. One method of doing this is by the diffusion of charged particles into the inlet ring due to a concentration gradient where the charged particle density is greater outside the inlet electrode. The problem is to maintain that concentration gradient.

Figure 7A:
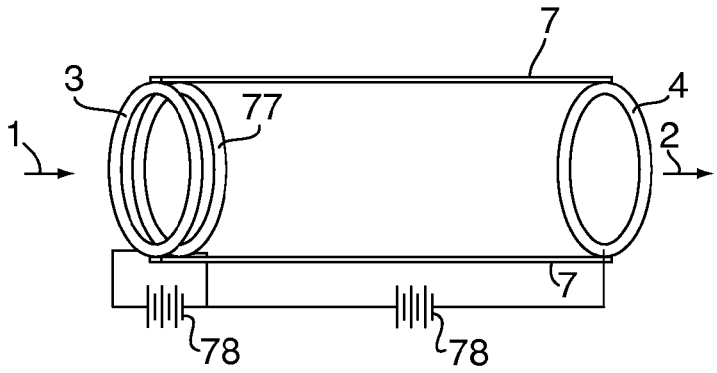
FIG. 7 shows methods for increasing the diffusion current.

In FIG. 7A, we show two closely spaced electrodes at the inlet of the engine. The additional electrode (77) provides an electric field that repels any charged particles back to the inlet electrode. While this appears to be simply a segmented engine, the functioning is different in that the spacing of the two electrodes (77) and (3) are as dose as possible to maximize the charged particle concentration gradient to maximize the diffusion current. Charged particles that are accelerated out the front electrode (3) by the negative space charge generated electric field will be trapped by the opposing field set up by the applied potential between electrodes (77) and (3).

Figure 7B:
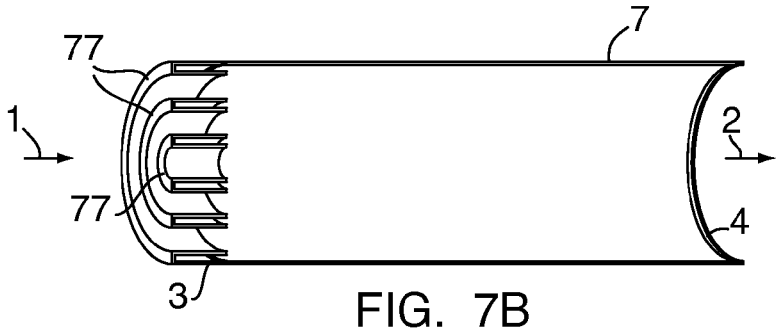

In FIG. 7B, we show the use of an actual physical barrier to stop the charged particles from leaving the front of the engine. The "U" shaped rings (79) form insulated regions where charged particles can be concentrated to increase the concentration gradient. Clearly, the physical structure of FIG. 7B can be combined with the electrode structure of FIG. 7A to maximize the trapping of the charged particles.

In FIG. 4 through FIG. 7, we have shown ways to counteract the space charged generated electric field primarily to increase the electrostatic thrust efficiency of the engine. Electrostatic thrust is potentially much more efficient than the thermodynamic thrust generated by a conventional chemical jet or rocket. This is because the energy supplied by the electric field is initially totally in the axial direction whereas in a chemical rocket or jet engine, the thermal energy is distributed randomly in all directions. But whatever the ultimate electrostatic thrust efficiency, the energy that does not go into generating the electrostatic thrust, the energy associated with the increase in the axial component of the velocity of the neutral reaction mass, will end up it the random thermal motion of the entire reaction mass. Some of this energy can be recovered.

Figure 8A:
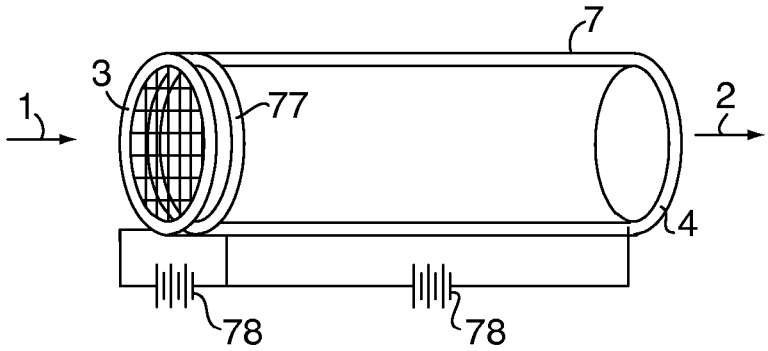
FIG. 8 shows methods of recovering thermodynamic energy from the reaction mass.

In FIG. 8A, we show what looks line the same structure as that shown in FIG. 7A, used to trap charged particles to increase the charged particle density gradient. It does that but in addition it can be used to recover some of the thermodynamic energy. One way to recover some of this energy is through collisions of neutral air molecules with an axial velocity component toward the inlet electrode with the charged particles. If energy and momentum is transferred back to the charged particle either slowing the particle or reversing its direction, the charged particle will either draw less energy or return energy to the electric field. In FIG. 8A, the region between the accelerating electrodes (3) and (4) will recover energy while the large charge density between electrode (77) and electrode (3) will ensure that all energy associated with the neutral air mass moving toward the inlet electrode will either be recovered or will be converted into additional thermodynamic thrust.

Thermodynamic thrust is created when the pressure in a container open on one side is greater than the ambient pressure. In the charged particle engine, the thermodynamic energy is the same as the thermodynamic energy caused by the burning of fuel in a chemical rocket or jet engine. This thermodynamic energy appears in the form of an increase in the temperature of the reaction mass. While this temperature increase is quite small and results in a very slight increase in pressure, if the engine is operated with accelerating voltages near breakdown, the thrust associated with this increase in pressure can be an order of magnitude greater than the electrostatic thrust if the reverse electrostatic field is not reduced. To convert this increased pressure into thrust, the neutral particles moving toward the inlet electrode must be prevented from leaving the front of the engine. In essence, we must close the inlet to the passage of neutral molecules moving out of the engine but not block them moving into the engine. It is the same problem facing a turbojet engine and all of the methods used in turbojet engine designs can be used here such as aerodynamic pressure (ram jet), inlet shutters (pulse jet), mechanical compressors (turbojets), etc. But we can also use collisions of the neutral molecules moving toward the inlet electrode with the charged particles to transfer momentum through the electric field back to accelerating electrodes. That is also what is occurring in FIG. 8A when we use the high density charged particle region to recover the momentum of the forward moving neutral molecules converting it to thrust.

Figure 8B:
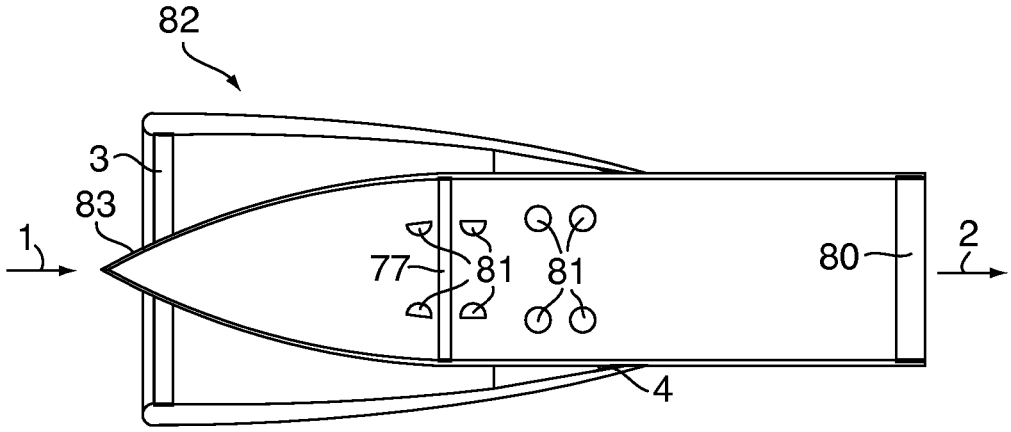
Figure 8C:
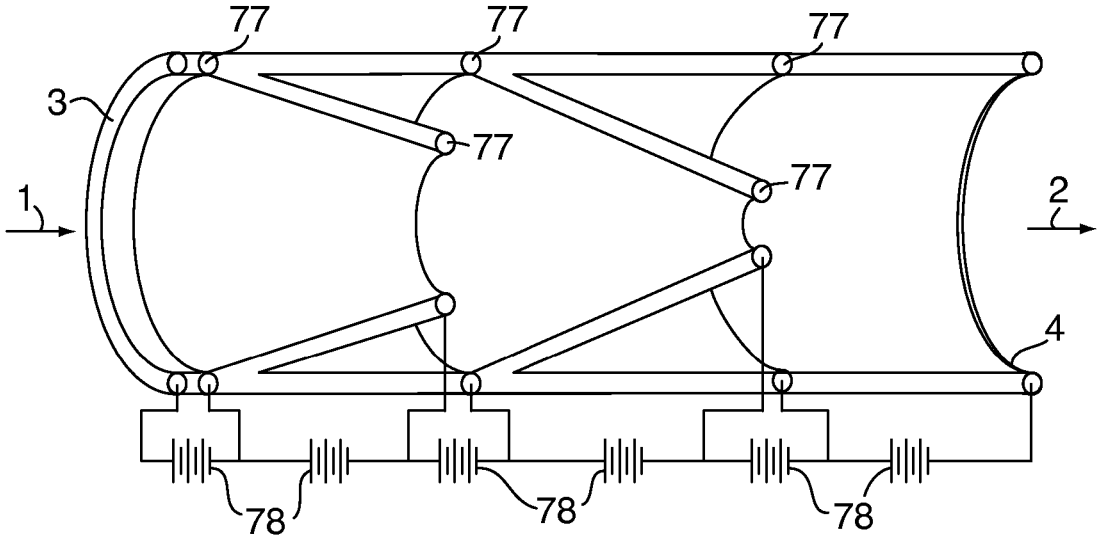

In FIG. 8B, we use a large charge particle engine (82) with electrodes (3) and (4) to "pump" neutral molecules into an enclosed second charge particle engine with electrodes (77) and (80) through openings between the two engines (81) where the majority of the thermodynamic energy associated with the acceleration of the charged particles in the contained engine can be recovered mechanically due to the dosed front (83) of the contained engine. In FIG. 8C, we have shown the concept of embedded segmented engines where the thermodynamic energy can be recovered at each stage.

The drawings of FIG. 9 all deal with variable geometry structures of the charged particle jet engine. They all come about based on two principles of the charged particle jet engine; for a given thrust, the thrust energy decreases as mass flowing between the electrodes increases so increasing the area of the medium inlet results in greater mass flow and lower thrust energy and increasing the spacing between electrodes results in more collisions per charged particle so fewer charged particles are required.

Figure 9A:
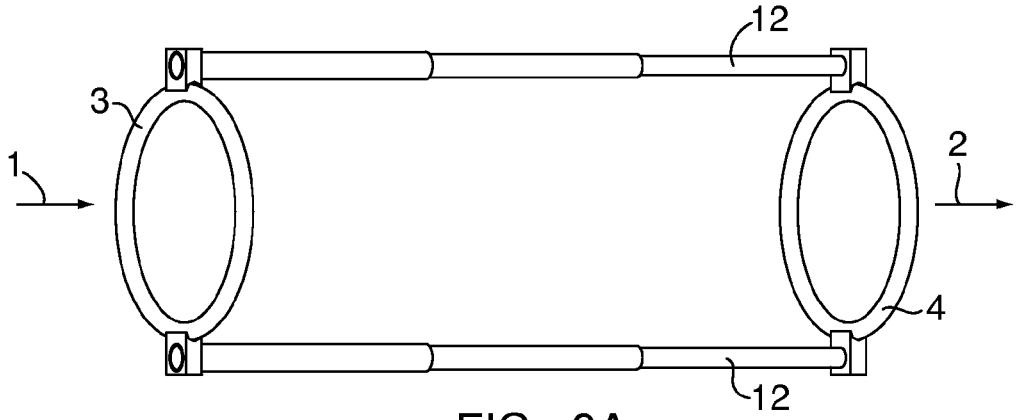
FIG. 9 shows several methods of changing the structure of the invention dynamically while in operation to optimize the characteristics of the invention as the need arises.
Figure 9B:
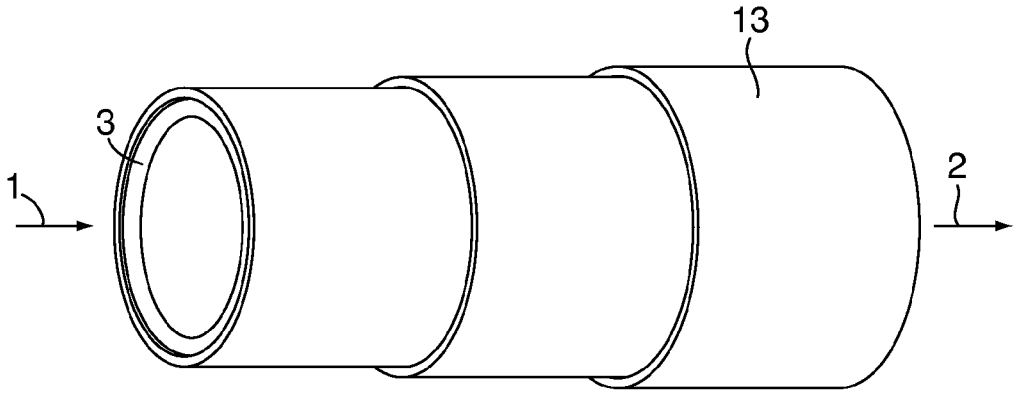
Figure 9C:
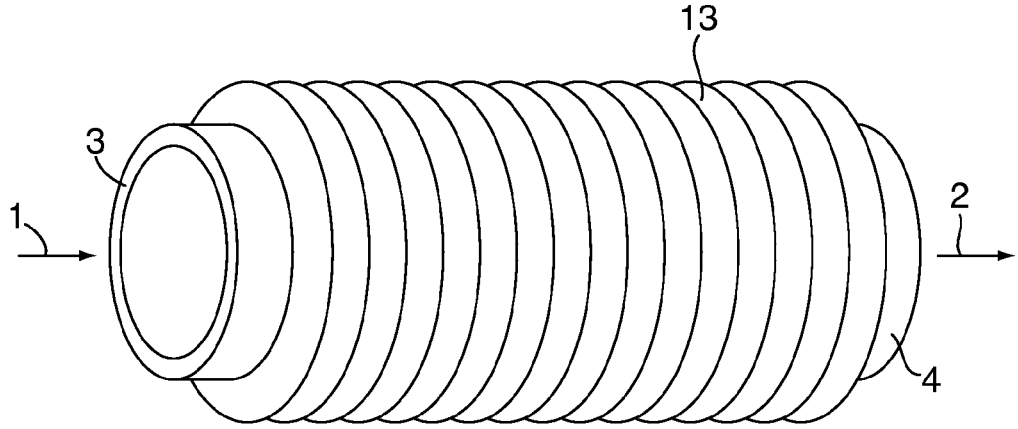
Figure 9D:
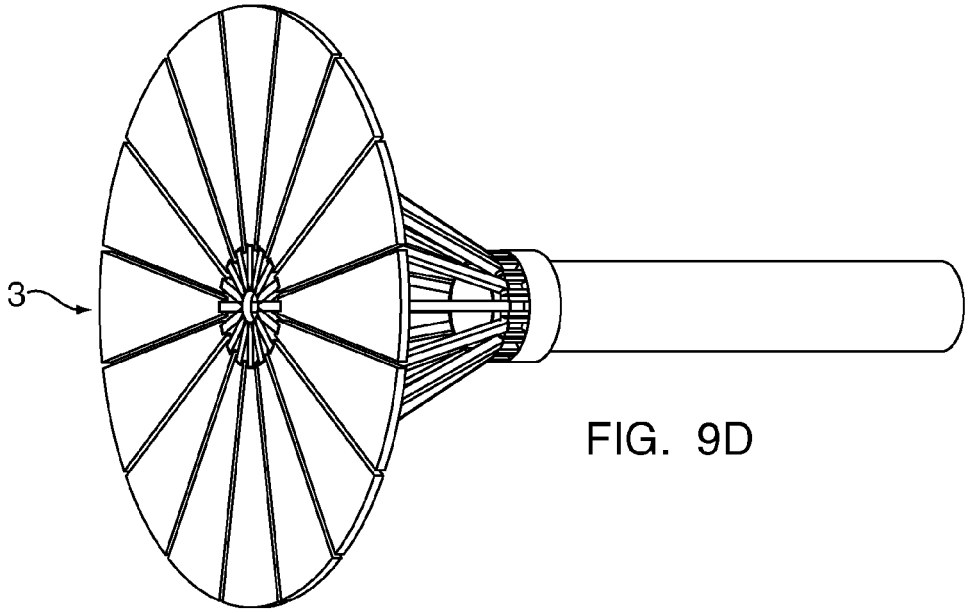
Figure 9E:
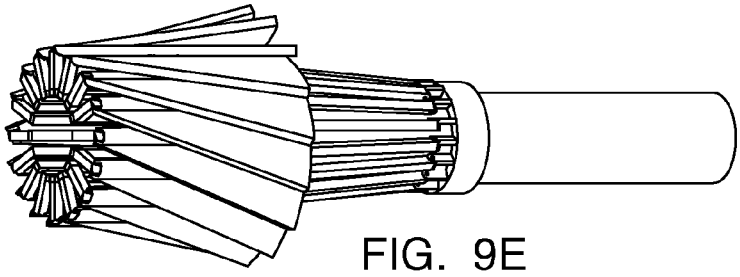
Figure 9F:
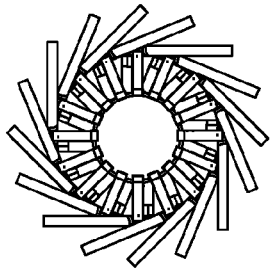
Figure 9G:
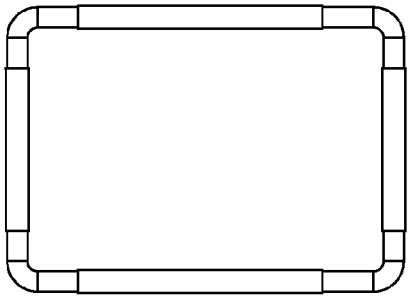
Figure 9H:
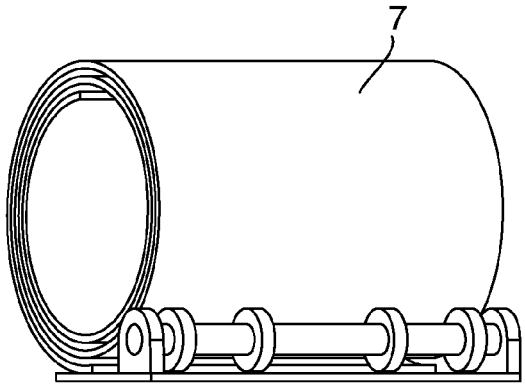

In FIG. 9A, the separation of the accelerating electrodes of the open frame design can be varied by the telescoping electrode supports (12). FIG. 9B shows a telescoping enclosure using rigid sections (13), while FIG. 9C shows a flexible hose type design. FIG. 9D through FIG. 9F show an umbrella type design where the first electrode is a solid material that opens like an umbrella. In this configuration, the medium enters the region between the electrodes through the central entry region (3) and through the region below the first electrode. FIG. 9G shows a rectangular electrode whose area can be altered by the telescoping electrode sections. FIG. 9H shows an enclosed circular electrode configuration where the diameter of the enclosure can be varied by spooling and unspooling the flexible enclosing material (7).

The drawings of FIG. 10 all illustrate methods used to create vectored thrust. In these drawings, the point of charged particle injection is not shown but is understood to be near the entry region of the medium that can change depending on the potentials applied to the individual electrode segments. FIG. 10A is a basic open frame configuration where the electrodes have been segmented using insulating sections (14) so that varying potentials can be applied between the segments. For example, to vector the thrust in a downward direction, the accelerating potential can be applied between the top front electrode segment and the rear bottom segment. This results in the charged particles being accelerated diagonally from top to bottom as they travel between the electrodes. FIG. 10B shows the segmented rectangular electrodes. Only limited thrust vectoring is possible but only a single ion injection point is needed unless bi-directional thrust is desired in which case provision must be made to supply charged particles to whichever region is acting as the medium input.

Figure 10A:
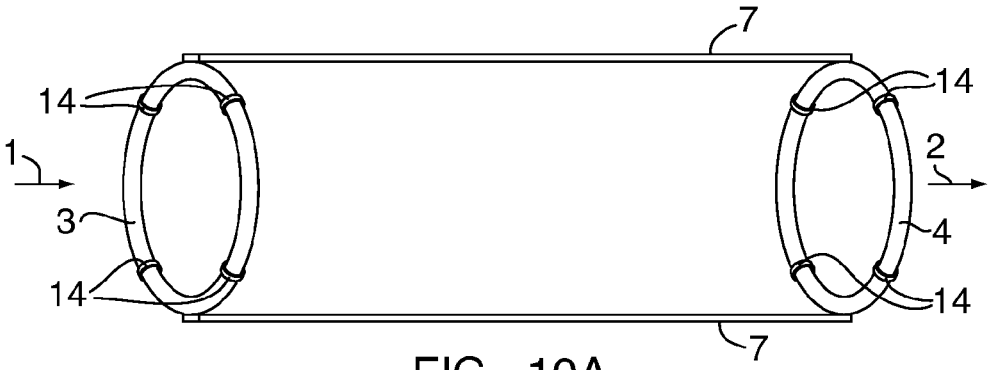
FIG. 10 shows several methods that can be used to vary the direction of thrust, thrust vectoring, through both electrical and mechanical means.
Figure 10B:
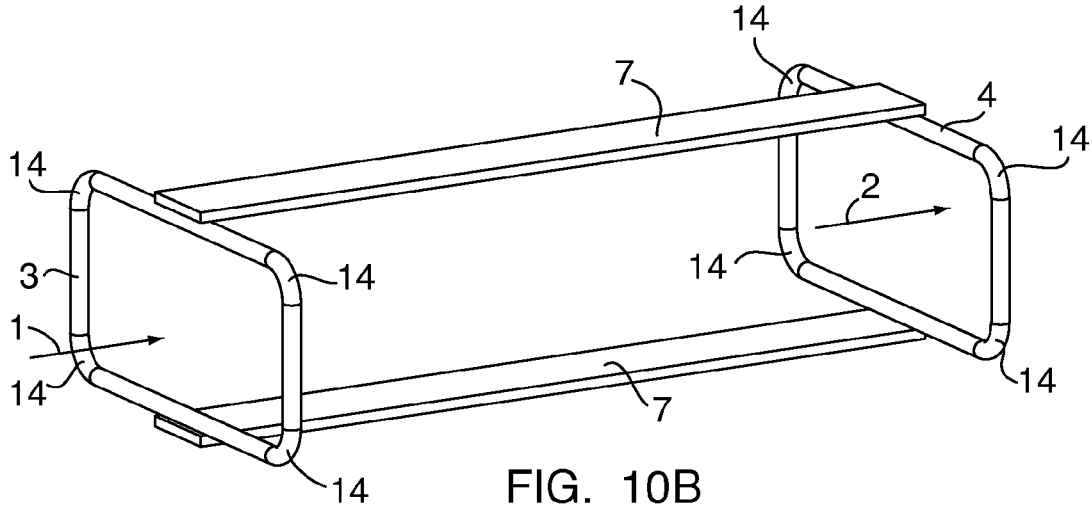
Figure 10C:
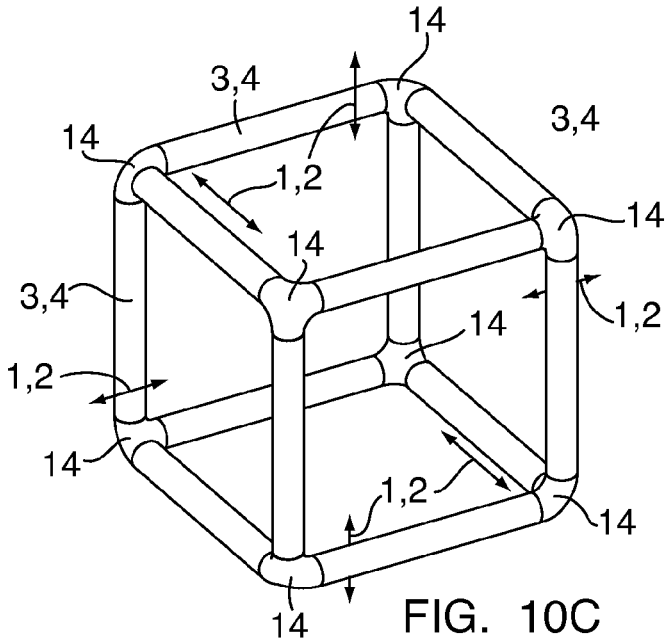
Figure 10D:
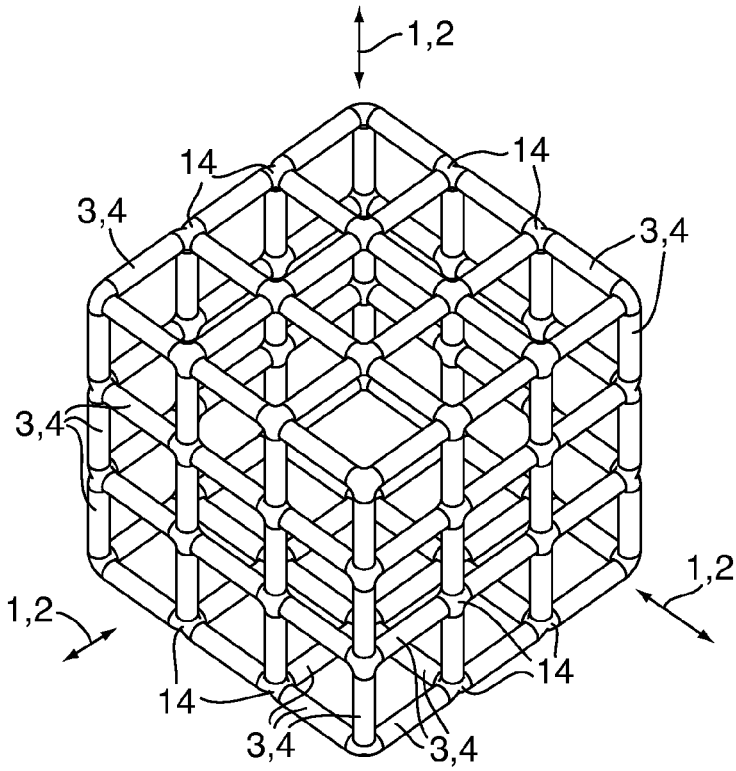
Figure 10E:
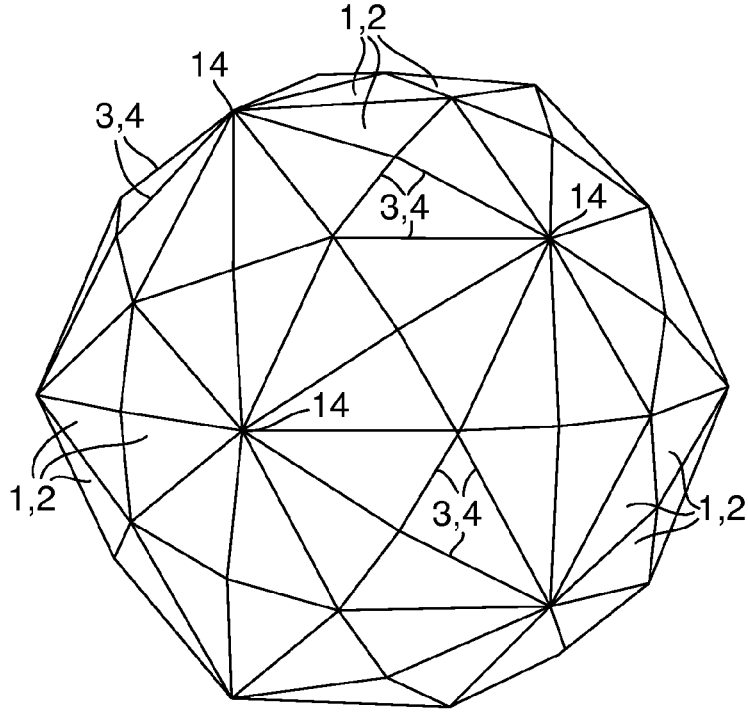

FIG. 10D shows a cube structure where the thrust vector can be in any direction as determined by the potential applied to the individual segments. FIG. 10D shows a cube divided into more sections that permit finer control and greater efficiency of the thrust vector. FIG. 10E shows a spherical shaped structure providing even finer control. In all of these structures, means must be provided to inject charged particles at the appropriate point.

Figure 10F:
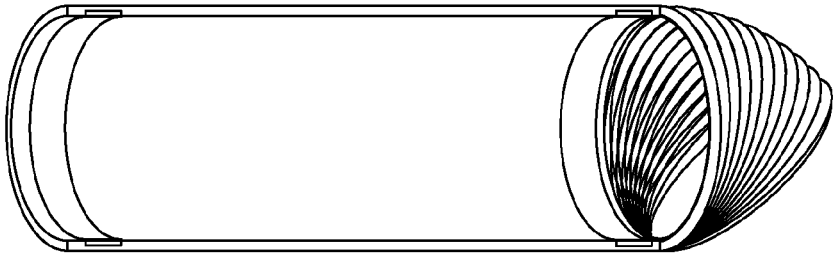
Figure 10G:
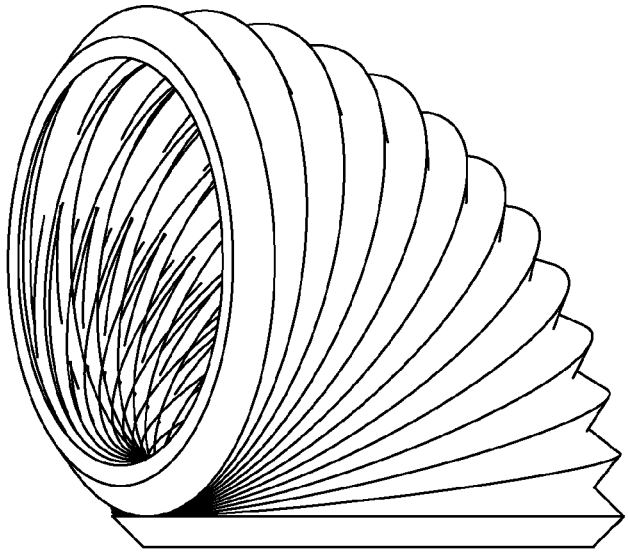

FIG. 10F shows a flexible exhaust nozzle placed after the accelerating rings, that is used to change the vector of the exiting mass and behaves exactly the same as a directional control nozzle in a conventional vectored thrust jet engine in creating vectored thrust. In FIG. 10G, the electrodes are placed in the flexible enclosing material so that the electrodes also move as the nozzle is vectored causing both the neutral exhaust mass and the electrostatic force of the accelerating electrodes to be vectored.

Figure 10H:
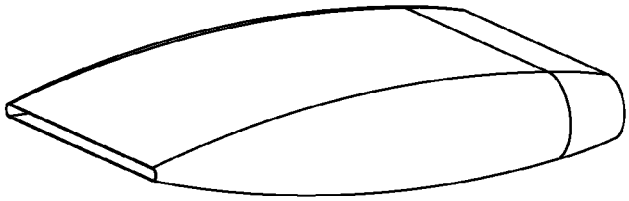
Figure 10I:
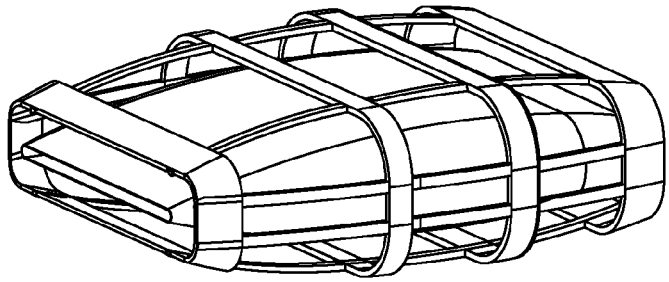

FIG. 10H shows a hypothetical vehicle which is enclosed in a cage of accelerating electrodes shown in FIG. 11I. Here, thrust can be applied to the vehicle in any direction by varying the potentials applied to the various segments and injecting charged particles at the appropriate points.

FIG. 11 illustrates the concept of charged particle recirculation. When the energy associated with the generation of the charged particles approaches the thrust energy, charged particle recirculation can be used to reduce the number of charged particles that must be produced. Note that charged particle recirculation can only be used with charged particle jet engines operating in a medium because the force necessary to turn the charged particle's direction completely cancels the thrust obtained from the charged particle when it is accelerated by the electrodes. It is only because the mass of the charged particles is millions of times less than the neutral particle mass that large net thrust can be obtained without the charged particle contribution that has been neutralized.

In charged particle recirculation, after the charged particles have collided with as many neutral particles as possible, the charged particles are collected near the exit electrode but are not neutralized. The exit electrode is insulated which still results in an electric field between the accelerating electrodes but charged particles will not be neutralized when they contact the insulated electrode. If the charged particles did not collide with neutral particles and lose energy they would have enough energy to "climb back up the potential hill" and would simply revolve around the two electrodes but because the charged particles have lost energy in the collisions, this lost energy must be replaced for the charged particle to make it back up the hill. This energy can not be replaced by an electrostatic field. It can be replaced, however, by a varying electrodynamic field.

Figure 11A:
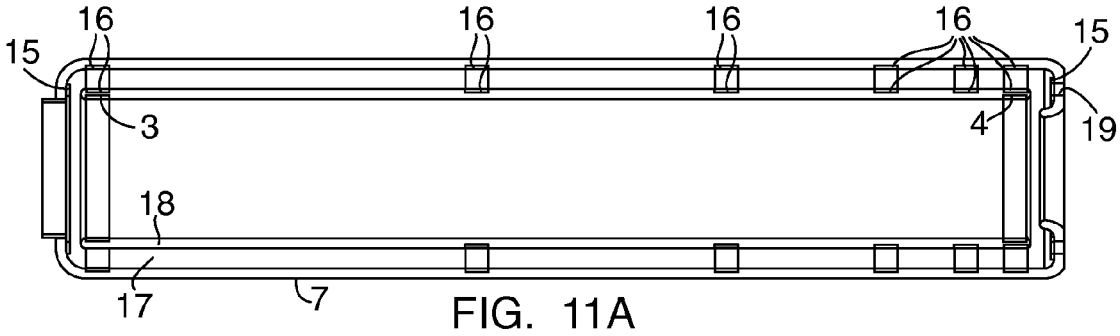
FIG. 11 shows several views of two methods of recirculating charged particles to minimize the energy needed for charged particle creation.

FIG. 11A shows a cutaway of a tube within a tube. The charged particles are accelerated by the accelerating electrodes (3) and (4) and are "collected" by the exit electrode (4) where their direction is reversed either by a magnetic field or by a static or varying potential applied to the reversing electrode (15) causing the charged particles to enter the region between the two cylinders (17) and (18). An opening (19) is provided in the reversing electrode to allow neutral particles to escape. Varying potentials applied to the reverse acceleration electrodes (16) accelerate the charged particles giving them sufficient energy to "make it back up the potential hill". It is important to note that if the charged particles are not neutralized by the exit electrode the forward accelerating electrodes do not supply any net energy to the charged particles. This occurs because any energy that the charged particle obtains from the accelerating rings traveling from the entry ring (3) to the exit ring (4) is returned when the charged particle returns to the entry electrode.

Figure 11B:
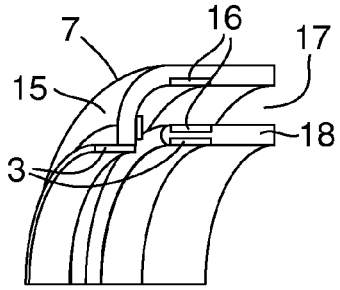
Figure 11C:
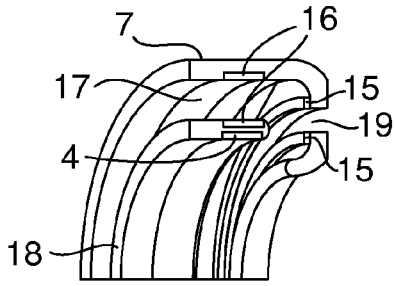

When the charged particle reaches the end of the return region adjacent to the entry ring, a reversing electrode (15) or a magnetic field again alters the direction of the charged particles injecting them again into the entry region between the two accelerating electrodes. It is important to note that any neutral particles that are accelerated along with the charged particles in the return region (17) will transfer their energy in the form of forward thrust when they can't make the turn at the end of the return region (17) and collide with the end of the region. FIG. 11B and FIG. 11C show three-dimensional detail views of the ends of the charged particle return region.

Figure 11D:
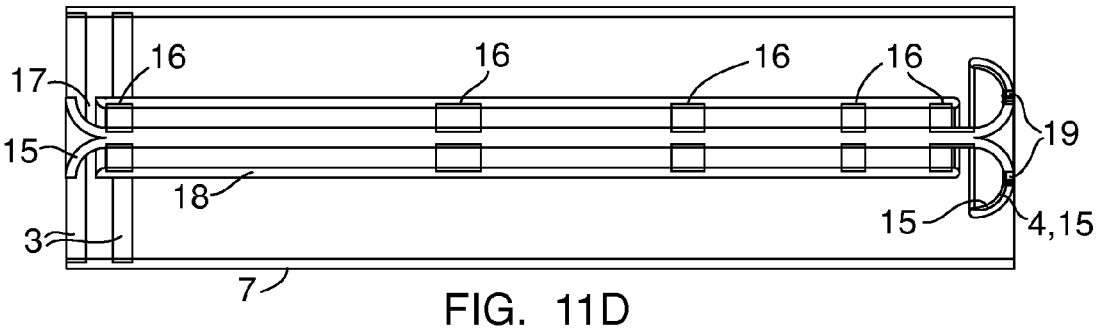
Figure 11E:
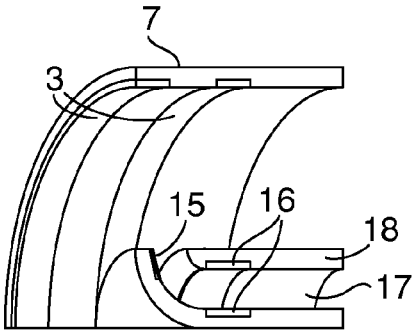
Figure 11F:
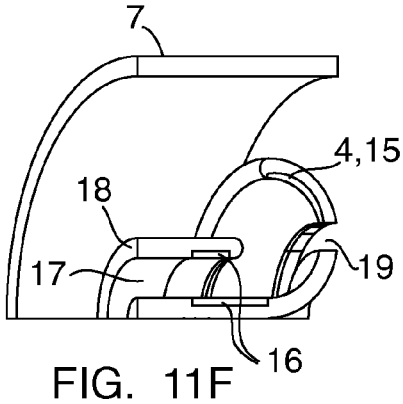

FIG. 11D through FIG. 11F show a recirculation structure axially located in the center of the acceleration region. It is also possible that both an outer and inner recirculation path are used as forward thrust efficiency will be increased by the more uniform electrostatic field of inner and outer electrodes and the more uniform injection of the recirculated charges.

Figures 12A, 12B, 12C, 12D:
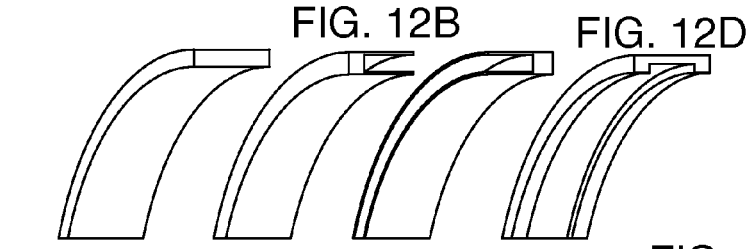
FIG. 12 shows sectioned views of various electrode shapes.
Figures 12E, 12F, 12G, 12H:
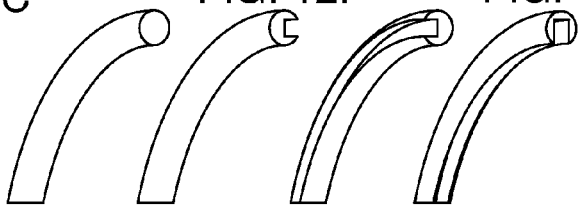
Figures 12I, 12J, 12K, 12L, 12M, 12N, 12O:
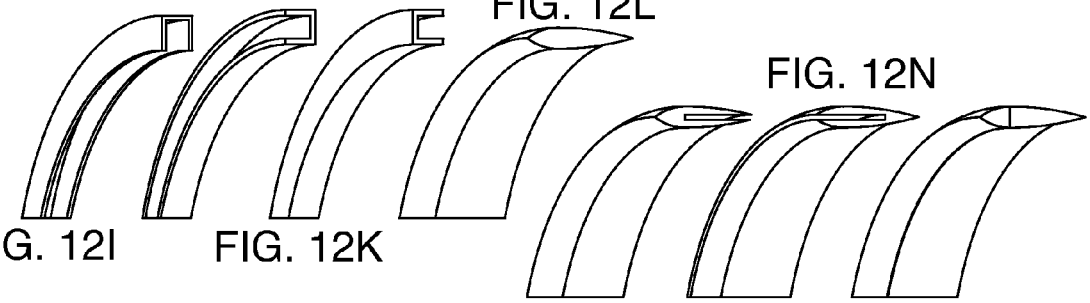

FIG. 12 shows detailed cutaway cross sectional views of several possible electrode structures. FIG. 12A through FIG. 12D have rectangular cross-sections that provide greater axial strength at the expense of streamlining. FIG. 12E through FIG. 12H have round cross sections that present less drag than the rectangular cross sections with less axial strength. The square cross sections of FIG. 12I through FIG. 12K provide both radial and axial strength at the expense of streamlining. FIG. 12L through FIG. 12O are cross sections of streamlined electrodes that result in the axial strength of the rectangular cross section with low drag.

Each of the cross sectional shape groups contains hollow electrodes with an opening pointing in various directions. They represent electrodes where the charged particle generator or injector is contained in the electrode and the openings are used to inject the charged particles either into the medium before it enters the region between the electrodes, across the electrodes to distribute the charged particles uniformly across the input area, and toward the exit region of the engine which can be used for exit electrodes for engines that produce vectored bi-directional thrust. FIG. 12O shows a streamlined cross sectional area where the leading edge is a transparent lens used with some photon ionization methods.

Figure 13A:
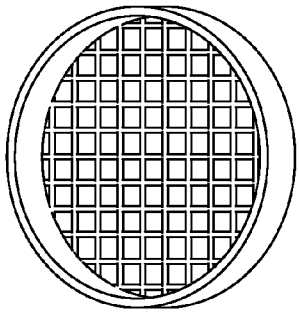
FIG. 13 shows several electrode shapes that can be used either alone or together to modify the electric field between the electrodes to optimize thrust efficiency.
Figure 13B:
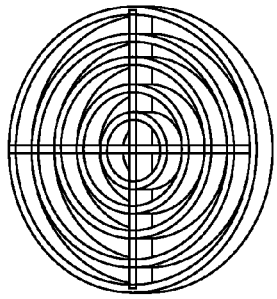
Figure 13C:
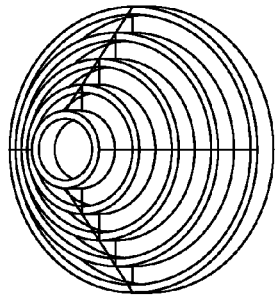

FIG. 13 shows various enhancements to electrode structures to create a more uniform electric field between the two accelerating electrodes. In FIG. 13A, a wire mesh or grille is used to create a flat electrical potential plane that results in a more uniform electric field between the electrodes. FIG. 13B uses concentric rings that results in a stronger more rigid unit at the expense of field uniformity. Remember that the thrust force is applied to the electrode and the mesh or rings connected to it so these structures must be made strong enough to handle this thrust force. FIG. 13C presents the concentric rings as a cone shape resulting in greater strength than the other two structures. While the electrode structures are shown as rings it is obvious that these methods used to enhance electrode properties can be applied to electrodes using other geometries.

Figure 14A:
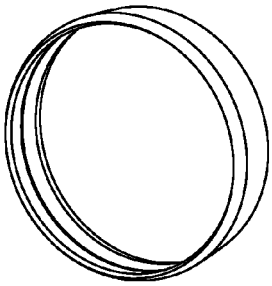
FIG. 14 shows several electrode configurations that can be combined with some types of charged particle generation to increase the production of charged particles.
Figure 14B:
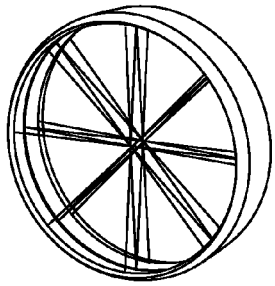
Figure 14C:
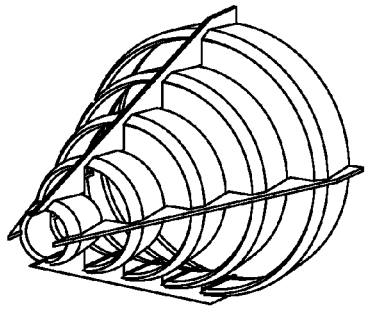

FIG. 14 shows possible electrode structures modified to facilitate charged particle generation and injection into the ring area. In FIG. 14A, the inside surface of the electrode forms a parabolic mirror so that photons used in photon ionization of the medium are bounced continuously across the area enclosed by the electrode to minimize the energy lost to photons that do not ionize an atom or molecule of the medium. FIG. 14B shows the photons being reflected around the interior of the region enclosed by the electrode. In actual practice, the photon distribution could be uniform around the electrode but may be concentrated into focused beams to enhance the ionization rate. In FIG. 14C, the cone of concentric rings with internal reflectors, stronger under compressive loads, is used to create a volume where the photons will be contained within the region enclosed by the electrode.

FIGS. 15 and 16 show methods of obtaining charged particles for use in the charged particle jet engine. We divide charged particles into two classes, traditional positive and negative ions and larger particles that have been given a positive or negative electric charge. Positive ions can be created by the absorption of photons by the bound electrons of the atom or molecule. If they absorb sufficient energy, the electron will be completely removed from the atom or molecule leaving the atom or molecule with a net positive charge. Both positive and negative ions can be created by bombarding an atom or molecule with some particle, usually an electron, that is either captured by the atom or molecule forming a negative ion or by transferring sufficient energy (24) to an electron bound to the atom or molecule such that the bound electron is completely removed from the atom or molecule leaving the atom or molecule with a net positive charge. Non-ionic charged particles are larger particles that have acquired either a positive or negative charge. This includes materials that are manufactured with a permanent positive or negative charge.

Figure 2B:
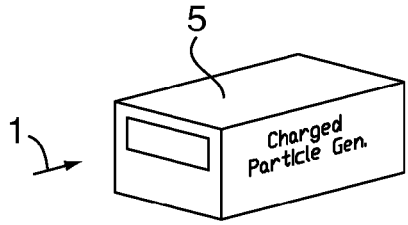
Figure 2C:
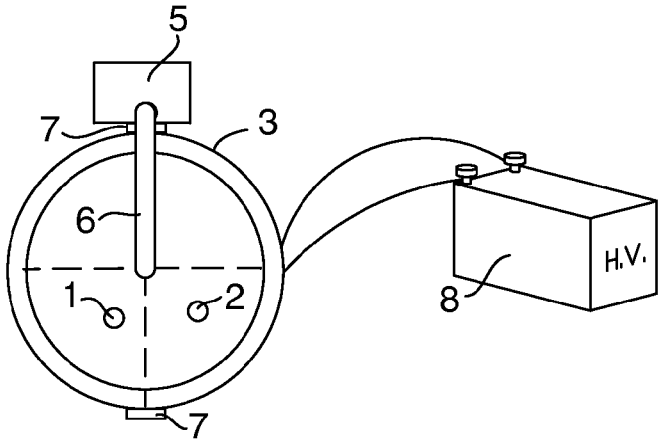

FIG. 15 shows several methods of using electromagnetic waves to generate ions directly in the vicinity of the medium entry region of the engine or in separate structures surrounding the outside periphery of the entry accelerating electrode. While the charged particle generator of FIG. 2B shows the charged particle generator as a separate structure, the methods shown in FIG. 15A through FIG. 15K incorporate the charged particle generator in the electrodes themselves.

Electromagnetic waves can be an efficient way of generating ions. Photons of electromagnetic radiation are readily absorbed by electrons surrounding atoms and molecules. If the energy of the photon is greater than the ionization energy of an atom or molecule, a single photon will ionize each ion or molecule. Ignoring the possibility of capturing two photons by a single atom or molecule, single photon ionization will be nearly 100% efficient. Unfortunately for oxygen and nitrogen, the ionization energy is in the 15 electron volt range corresponding to very short wavelength ultraviolet radiation. High output short wavelength efficient ultraviolet light sources are currently in development but are not available yet. When they are available, they will be the preferred choice for electromagnetic wave ion generation.

Multiple photon ionization is less efficient because a single atom that has absorbed one or more photons must absorb the remaining photons before the energy of the preceding photons is radiated away. Additionally, if an atom has not absorbed sufficient photons to become fully ionized before it moves out of the region where these photons exist, the energy of the absorbed photons will again be lost.

Figure 15A:
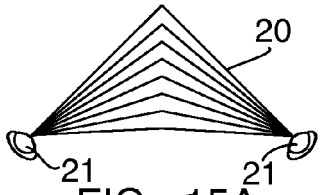
FIG. 15 shows several efficient methods of generating ions using electromagnetic radiation.
Figure 15C:
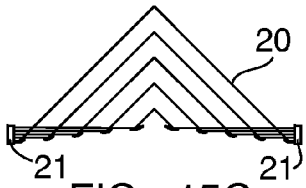
Figure 15E:
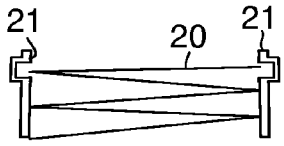
Figure 15B:
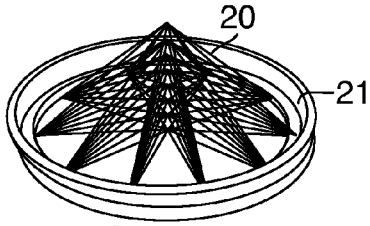
Figure 15D:
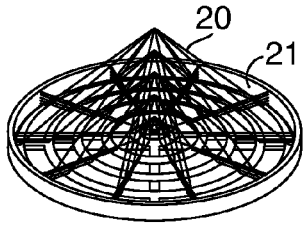
Figure 15F:
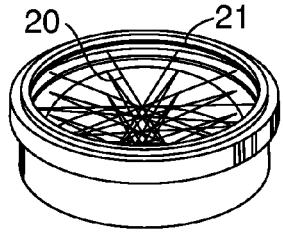
Figure 15G:
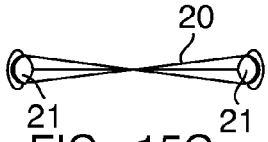
Figure 15I:
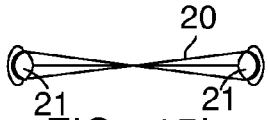
Figure 15H:
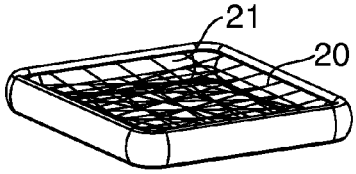
Figure 15J:
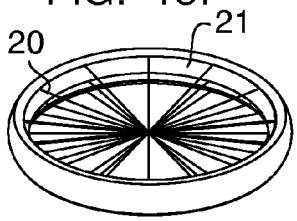

The way to maximize ion creation using the minimum amount of energy is to use as few photons as possible to ionize each atom or molecule. Visible light will require five to eight photons to fully ionize an oxygen or nitrogen atom. This leads to some of the approaches shown in FIG. 15. In FIG. 15A and FIG. 15B, the photons (20) are aimed ahead of the engine so that atoms and molecules of the medium remain in the ionization region filled with photons for a longer period of time. In FIG. 15C and FIG. 15D, the photons (20) from multiple rings (21) are aimed forward. In FIG. 15E and FIG. 15F, the photons (20) are reflected across the area enclosed by the electrode (21) but the length of the electrode is increased to create a larger ionization volume. FIGS. 15G through 15J illustrate narrow electrodes (21) with a short ionization region that would be advantageous when single photon ionization is used.

Figure 15K:
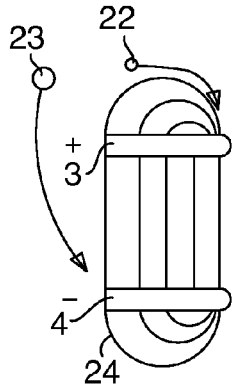

Once the ion is created, the ion and its emitted electron must be separated to prevent them from recombining. This is easily accomplished by using an electric field to separate the ion and electron. In the case of the photons (20) aimed ahead of the accelerating electrode, fringing electric fields will reach ahead of the electrode and can be used for this purpose as shown in FIG. 15K where the ion is (23), the electron is (22), the electric field is (24) and the accelerating electrodes are (3) and (4).

The problem with multiple photon ionization is that the photon beam intensity must be high for the probability of multiple photon capture to be high yet only one in several million atoms needs to be ionized. One way to deal with these conflicting requirements is to focus the photons into narrow beams so that the photon density is high in the beams while only a very few atoms and molecules are exposed to the photon beam. This can be done with all the methods shown in FIG. 15A through FIG. 15J by focusing the photons into these high intensity beams.

Figure 15L:
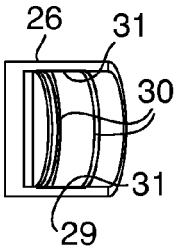
Figure 15M:
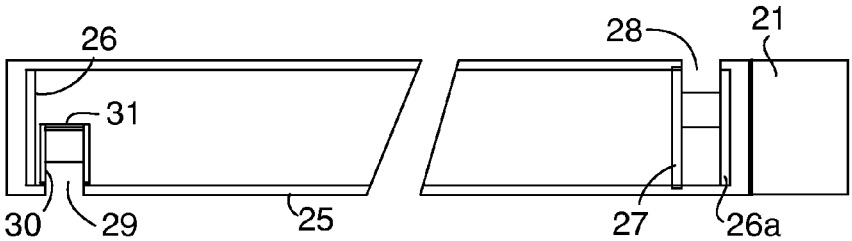

In FIG. 15L and FIG. 15M, an electromagnetic wave ionizer is shown that is separate from the accelerating electrodes. In this method, a very small tube (25) is used to contain both the photons and molecules. The entire interior surface is made of a highly reflective insulating material and the photons are admitted from the photon source (21) by either an aperture or a partially reflective mirror (26). Once in the cavity, the photons remain trapped as long as possible. Neutral atoms and molecules from the medium are introduced through small openings in the chamber (28) and (29). Opening (28) is only needed if insufficient neutral atoms and molecules are able to swim against the tide of ions leaving opening (29). These neutral atoms and molecules are constantly being bombarded by photons while in the photon cavity formed by the two mirrors (26) and (26*a*). Once the ion is created, electrodes (27), (30) and (31) separate the ion from the electron by a small electric field between electrodes (30) and (31) and electrode (27). Electrode (27) collects the electrons while the ions are directed out a small opening (29). Electrodes (30) and (31) form electrostatic deflection plates to sweep the ions through a wide volume to reduce the space charge density as quickly as possible and spread the ions uniformly throughout the selected region.

Figure 15N:
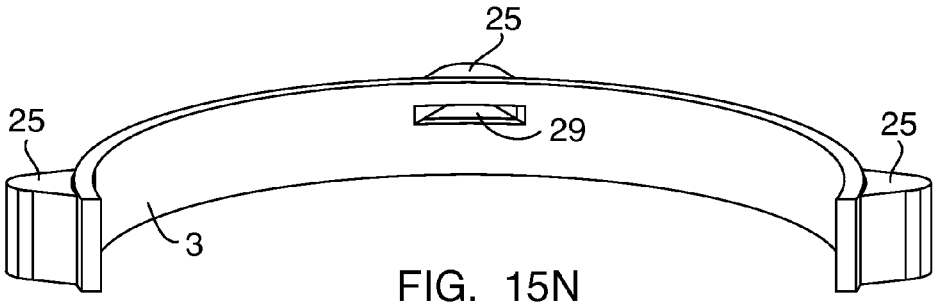

FIG. 15N shows a cutaway of a ring electrode showing the ion generator of FIGS. 15L and 15M attached to the electrode and the slots through the electrode that are used to inject the ions into the area surrounded by the electrode.

While the electric field between electrodes (30) and (31) could be increased to lessen the ionization energy needed to be supplied by the photons, once an ion is created, a large electric field will accelerate the ion and electron giving them more energy than is needed or required. The goal here is to create ions that have as little energy as possible.

FIG. 16 shows the use of methods other than electromagnetic ion creation to supply the required ions. FIG. 16A through FIG. 16R all generate charged particles by ionizing the gaseous or fluid medium. While ionization using electromagnetic radiation can only create positive ions by removing electrons, the methods shown in FIG. 16 can be used for both positive and negative ions.

Figure 16A:
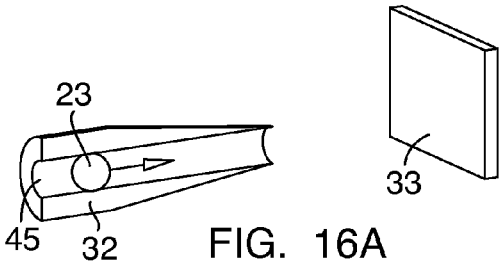
FIG. 16 shows several efficient methods of generating charged particles using particle collisions.
Figure 16B:
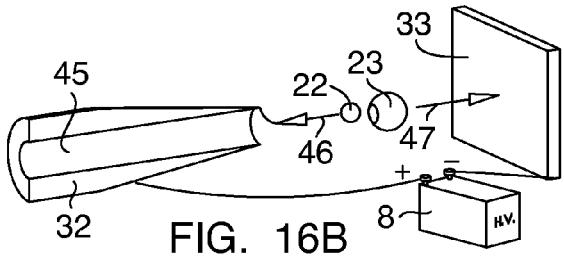
Figure 16C:
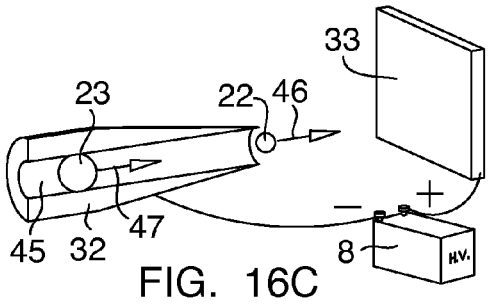
Figure 16D:
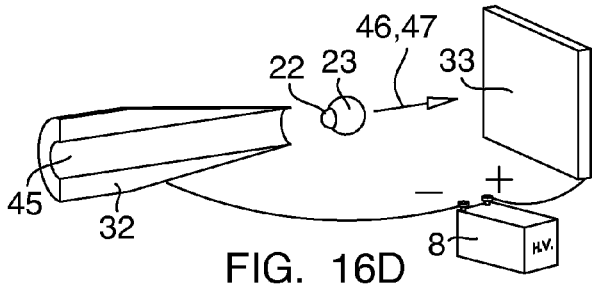

FIG. 16A through FIG. 16D show the basic "corona discharge" ionization structure where a sharp pointed electrode (32) is placed near a second large area electrode (33). The pointed electrode (32) is hollow and has a channel (45) that is the only way the atoms and molecules of the medium can enter into the region between the two electrodes. FIG. 16B shows the structure of FIG. 16A with the corona discharge voltage applied by a high voltage power supply (8) to the two ionization electrodes (32) and (33). The polarity of the applied voltage, the sharp pointed electrode positive and the large flat electrode negative, is such that positive ions will be created. FIG. 16C and FIG. 16D show the structure of FIG. 16A with the polarity of the of the power supply reversed to generate negative ions.

While the difference in generating positive or negative ions by the structure shown is only the polarity of the applied high voltage, the mechanism by which an ion is created is different. In the negative ion generator, the high electric field near the sharp pointed electrode shown in FIG. 16H (40) causes electrons to be emitted from the material by the process of high field electron emission. These freed electrons can then be captured by neutral atoms and molecules resulting in negative ions. Because positive charges cannot be emitted from the sharp pointed electrode, the ionization method is different. When a neutral atom or molecule is near the high electric field of the sharp pointed electrode FIG. 16H (40), less energy is needed to ionize an atom or molecule and it is accomplished by the absorption of energy from photons or free electrons in the vicinity of the neutral atom or molecule. Once an electron has been removed from an atom or molecule, the electron is accelerated by the high electric field shown FIG. 16H (40) and in that way acquires sufficient energy to knock outer electrons from other neutral atoms and molecules resulting in a cascade of ionizing electrons that ionize the atoms and molecules near the pointed electrode.

In FIG. 16B, the positive ion (23) has already been created by the removal of an electron (22) from the atom or molecule. The high electric field between the two electrodes (32) and (33) separates the ion (23) from its electron (22) by accelerating the ion and electron away from each other as shown by the ion trajectory (47) and the electron trajectory (46). In a conventional corona discharge ionizer, it would not matter where between the two electrodes (32) and (33) the ion (23) was created since the total energy obtained by the ion (23) and electron (22) together would be the same regardless of the creation point. If the ion (23) is created nearer the sharp pointed electrode (32), the ion (23) will have a greater share of the energy as it is accelerated toward the flat electrode (33) while if the ion (23) is created nearer the flat plate electrode (33), the electron (22) will acquire more energy than will the ion (23). If the created ions (23) are to be of any use, they must not be allowed to contact the flat plate electrode (33) or they will both be neutralized and the kinetic energy of the ion (23) obtained from the field between the two electrodes (32) and (33) will be transferred to the plate electrode (33) in the form of heat when the ion (23) impacts the plate electrode (33).

Assuming we keep the ion (23) from contacting the plate electrode (33), the electron (22) that was removed from the neutral atom or molecule could still acquire a great deal of energy if the ion (23) is created near the plate electrode (33). We do need the electron (22) to acquire some energy so that the electron cascade mentioned above will occur, but it needs to be limited to the minimum energy needed to sustain the desired ionization rate. That is the reason for the medium to be introduced in a controlled manner into the highest field region shown in FIG. 16H (40) nearest the pointed electrode (32). In this way, we increase the probability that the ion (23) will be created nearer the pointed electrode (32) thus minimizing the electron energy.

Figure 16E:
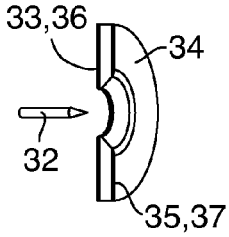
Figure 16F:
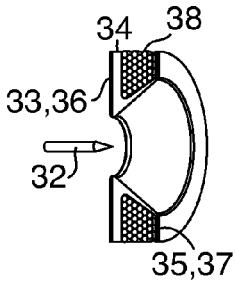
Figure 16G:
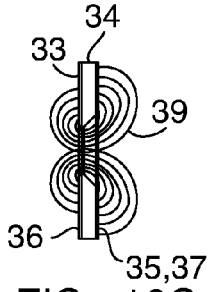
Figure 16H:
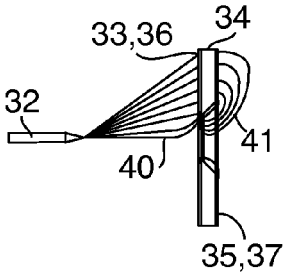

In the case of the negative ion generator shown in FIG. 16C and FIG. 16D, once the ion is created, there is only a single particle, the ion (23), that will be accelerated by the electric field shown in FIG. 16H (40) between the electrodes (32) and (33). This means that we only have to keep the ion from hitting the plate electrode to prevent the loss of kinetic energy to either electrode by collisions.

In FIG. 16E, we show one method that can be used to prevent collisions of the ions with the plate electrode. In this Figure, we place a hole in the plate through which the ions can pass without hitting the plate electrode. It is important to note that the kinetic energy of the ion is greatest at the plate electrode and, if it were allowed to collide with the plate electrode, the maximum energy per ion would be lost. The size of the hole necessary would depend on the spacing between the electrodes and the applied potential. While this method would prevent a large number of the ions from hitting the plate, it would not prevent all ions from hitting the plate. An enhancement to this method is to place one pole of a magnet (36) on one side of the plate (33) and the other pole (37) on the opposite side of the plate (33). The magnetic flux would then pass through the hole in the plate as shown in FIG. 16G. These flux lines would focus the ion beam through the hole in the plate and add an additional force keeping the ions away from the plate. In FIG. 16E, we use a permanent magnet to generate the magnetic field; while in FIG. 16F, we use an electromagnet (38). The permanent magnet is simpler and uses no energy while higher flux densities can be obtained from the electromagnet resulting in a greater focusing force for a given size.

In addition to the plate electrode (33), there is an additional deceleration electrode (35) on the side of the plate electrode (33) opposite the pointed electrode (32) and separated from the plate electrode (33) by an insulator (34). This electrode (35) is used to slow the ions (23) once they have passed through the hole in the plate electrode (33). The potential applied to the deceleration electrode (33) referenced to the pointed electrode (32) must be sufficient to prevent the ion from stopping and falling back to the plate electrode. For example, if the potential between the pointed electrode (32) and the plate electrode (33) is 10,000 volts and the ion (23) is created right at the pointed electrode (32) so that it has acquired 10,000 electron volts of energy by the time it reaches the plate electrode (33), applying zero volts between the pointed electrode (32) and the deceleration electrode (35) will cause the ion (23) to have zero energy when it reaches the deceleration electrode (35). In this way, the potential applied between the pointed electrode (32) and the deceleration electrode (35) will set the final energy of the ions (23) leaving the ionizer and not the potential applied between the pointed electrode (32) and the plate electrode (33) as would be the case if we used the accelerating electrodes (3) and (4) of the ion jet to generate the ions (23).

There are additional considerations that must be dealt with in the ionizer. Because the energy acquired by a negative ion (23) in a negative ion generator is independent of the point of ionization between the pointed electrode (32) and the plate electrode (33), if no energy is lost from the ion (23) by collisions with other particles, the potential applied between the pointed electrode (32) and the deceleration electrode (35) can approach zero volts. For the positive ion generator, however, the point of ionization between the pointed electrode (32) and the plate electrode (33) determines the ultimate energy of the ion (23) when it reaches the plate electrode (33). For this reason, the spread of energies of positive ions leaving the ionizer will be greater than will the energy spread for negative ions.

Because the deceleration electrode (35) voltage must be set to prevent the majority of ions (23) from falling back onto the plate electrode (33), any energy lost by collisions of the ions (23) with other particles must be minimized to limit the spread of energies of ions (23) leaving the ionizer. For this reason, the number of neutral atoms and molecules must be limited in the region between the pointed electrode (32) and the deceleration electrode (35). By having the medium enter through the pointed electrode (45) in a controlled fashion, the number of neutral atoms and molecules between the pointed electrode (32) and the plate electrode (33) are minimized. By setting the potential of the deceleration electrode (35) at a value that leaves the ions (23) with a small amount of energy at the deceleration plate (35), the ions (23) will act as an ion pump, removing neutral atoms and molecules from the region between the pointed electrode (32) and the deceleration electrode (35).

FIG. 16G shows a cross-sectional view of the plate electrode (33), deceleration electrode (35), the magnetic pole pieces (36) and (37), the insulator (34) between the plate electrode (33) and deceleration electrode (35), and the magnetic field (39) produced by the magnetic pole pieces (36) and (37).

Figure 16I:
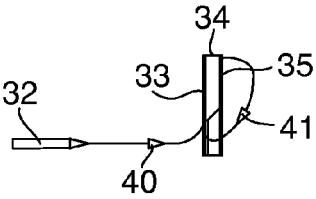
Figure 16J:
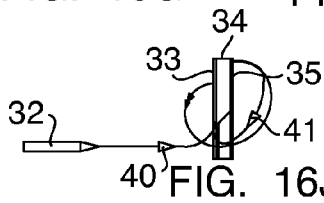

FIG. 16H shows a cross-sectional view of the plate electrode (33), deceleration electrode (35), the magnetic pole pieces (36) and (37), the insulator (34) between the plate electrode (33) and deceleration electrode (35), and the accelerating electrostatic field (40) produced by the potential applied between the pointed electrode (32) and the plate electrode (33) and the decelerating electric field (41) produced by the potential applied between the plate electrode (33) and the deceleration electrode (35). FIG. 16I shows a more detailed cross section showing a single acceleration field line (40) and single deceleration field line (41). FIG. 16J shows the superposition of a single acceleration field line (40), single deceleration field line (41), and a single magnetic field line (39).

Figure 16K:
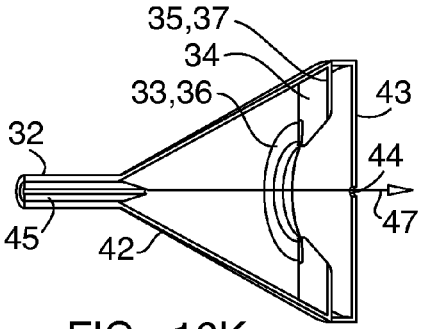
Figure 16L:
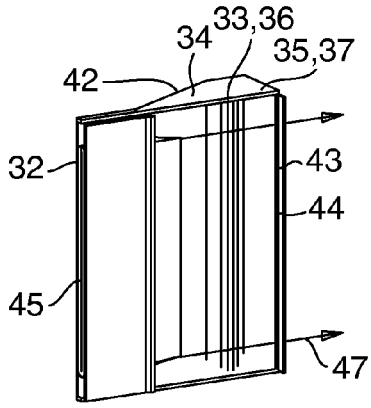

FIG. 16K shows a cross section of the completely enclosed ionizer. The entire set of electrodes is sealed from the medium by the endosure (42) and (43). The medium enters through the hollow pointed electrode (32) through the tube (45) and the ions (23) leave through the exit opening (44). FIG. 16L shows the same structure as the ionizer of FIG. 16K but the electrodes are now two-dimensional for increased ion production. Instead of a pointed electrode (32) it is now a hollow blade electrode (32) and the other electrode shapes are now rectangular with a slot through the plate electrode (33), insulator (34) and deceleration electrode (35). The exit opening (44) has also been changed to a slot. While both one-dimensional "point" electrodes and two dimensional "line" electrodes have been shown it is obvious that the two-dimensional straight line can be made of any arbitrary two-dimensional shape.

Figure 16M:
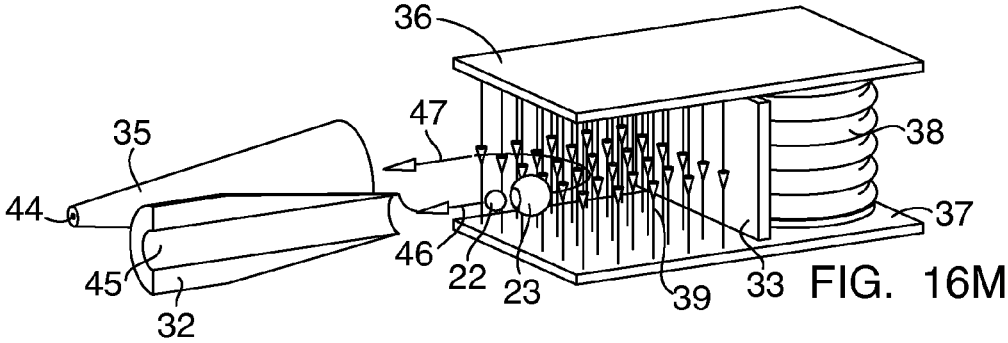
Figure 16N:
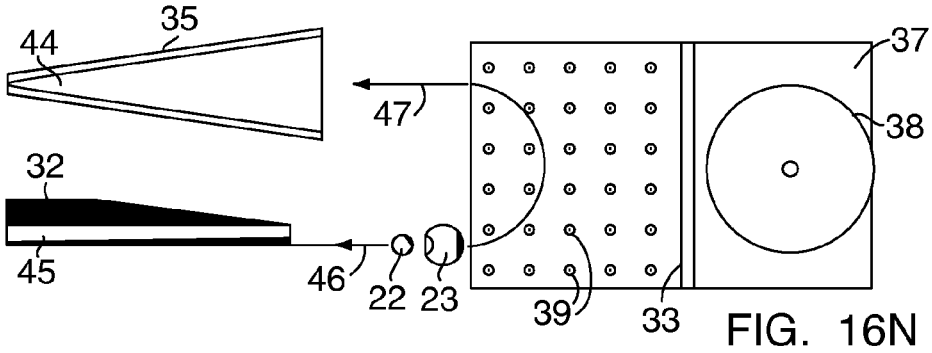
Figure 16O:
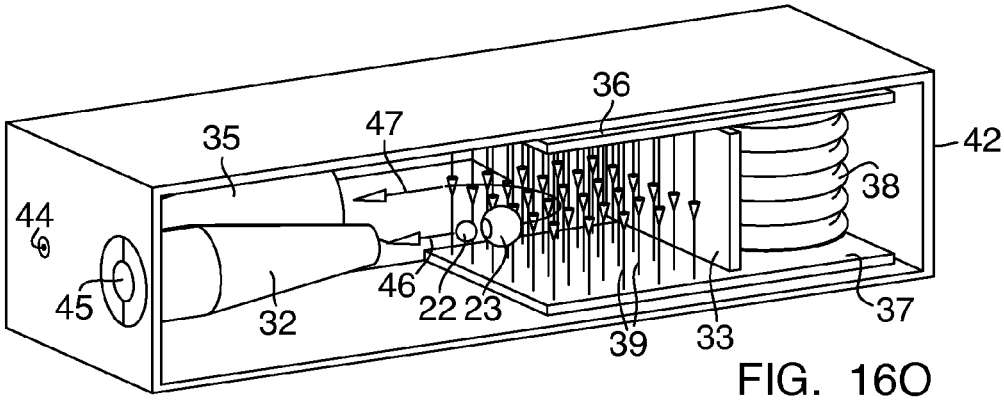
Figure 16P:
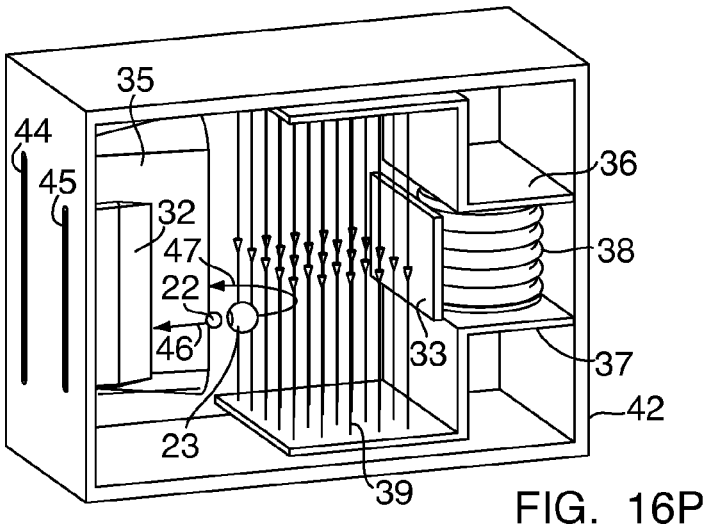

FIG. 16M shows an alternative structure for creating ions (23) using a large electrostatic field. The principle is the same, the electrostatic field is used to create the ions (23) and a magnetic field (39) is used to keep the ions (23) from hitting plate electrode (33) while at the same time they are being decelerated by the deceleration electrode (35). In this method, a magnetic field (39) perpendicular to the accelerating electric field is used to make the ions (23) follow a curved trajectory (47) away from the plate electrode (33). The deceleration electrode is now funnel shaped to both decelerate the ions and focus them so that they will pass through the exit opening (44). FIG. 16N shows a top view of the ionizer to better show the ion (23) trajectory (47) and electron (22) trajectory (46). FIG. 16O shows the ionizer inside an enclosure to control the entry of the medium into the ionizer. FIG. 16P shows the two-dimensional blade electrode configuration equivalent to the FIG. 16L.

Figure 16Q:
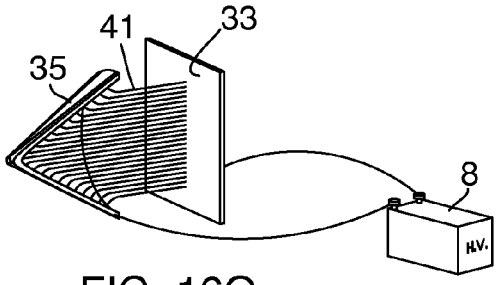
Figure 16R:
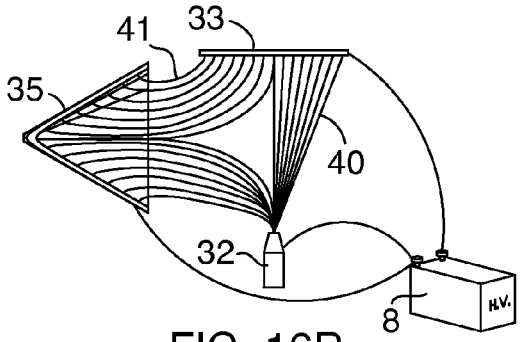

FIG. 16Q shows the decelerating electric field (41) between the plate electrode (33) and the deceleration electrode (35). The electric field (41) that is used to decelerate the ions also focuses the ions into the funnel since the electric field is in a direction to force the ions away from the deceleration electrode (35). FIG. 16R shows both the accelerating electric field (40) and decelerating electric field (41) where the decelerating electrode (35) is perpendicular to accelerating electric field (40). The angle that the decelerating electrode (35) makes with the accelerating electric field (40) can be varied to change the angle between the input (45) and output (44) regions as the need arises.

Figure 16S:
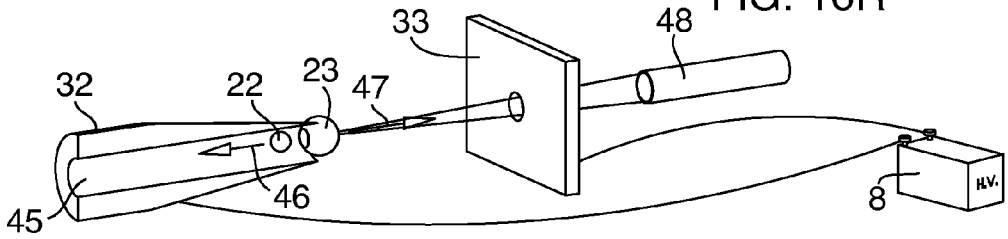

FIG. 16S shows a laser beam (48) focused at the tip of the pointed electrode to enhance the creation of positive ions (23) near the pointed electrode (32) to both lower the potential that must be applied between the pointed electrode (32) and the plate electrode (33). By forcing the ionization at the tip of the pointed electrode (32), the energy spread of positive ions is reduced and the energy lost by the removed electron (22) being accelerated toward the pointed electrode (32) is also reduced.

Figure 16T:
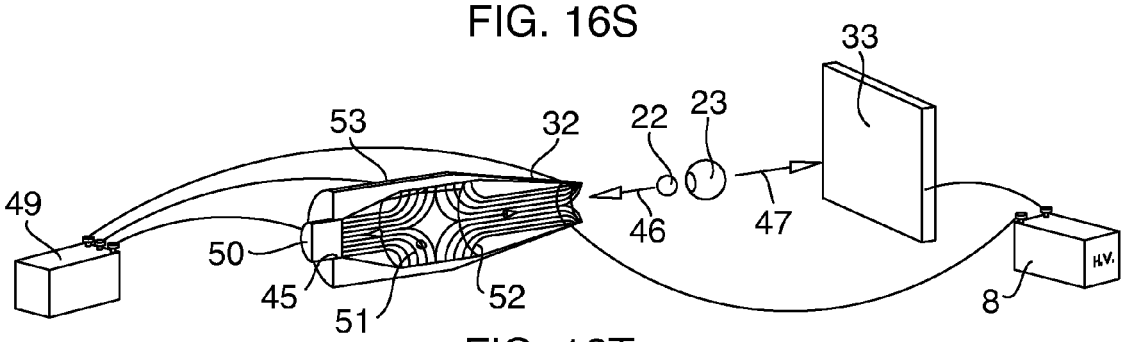

In FIG. 16T, the pointed electrode has been modified with the addition of an electron source (50). For negative ion generators, the electron source can be used as the source of electrons to be captured by the neutral atoms and/or molecules. For positive ion generators, the electrons from the electron source can be injected into the pointed electrode with sufficient energy to knock electrons from the neutral atoms and/or molecules creating positive ions. These electrons must have sufficient energy to have enough energy remaining after it has transferred energy to the electron removed from the atom or molecule when the ion is created to ensure that it will not be captured by the ion thus just swapping electrons but not creating ions.

One of the problems with most electron sources is that they are either relatively inefficient as are thermally emitted electrons or they are created with relatively high energies when cold cathodes or field emission is used. Just like the decelerating field between the plate electrode and decelerating electrode used to recover energy from the high energy ions (23) at the plate electrode (33), a decelerating field can also be used to recover energy from electrons that are created with high energy as a byproduct of creation process. In FIG. 16T, three electrodes, the electron source electrode (50), the electron deceleration electrode (53) and the pointed electrode (32) are used to control the behavior of the electrons supplied by the electron source (50). The potential (49) applied between the electron source (50) and the deceleration electrode (53) determines the energy of the electrons at the medium entrance point (45) after being accelerated by the electric field (51). The potential applied between the electron deceleration electrode (53) and the pointed electrode (32) determines the electron energy as it is being accelerated by the electric field (52) in the region where the electrons collide with the medium to produce the ions. For negative ion generation, the electrons can be slowed to the point where electron capture is maximized. For positive ion generation, the energy can be set to the minimum value necessary to strip electrons from the medium without the colliding electrons being captured. Note also that the laser enhanced ionizer of FIG. 16S can be used with the electron generation ionizer of FIG. 16T to enhance the production of positive ions with minimum energy spread and minimum ion energy.

Figure 16U:
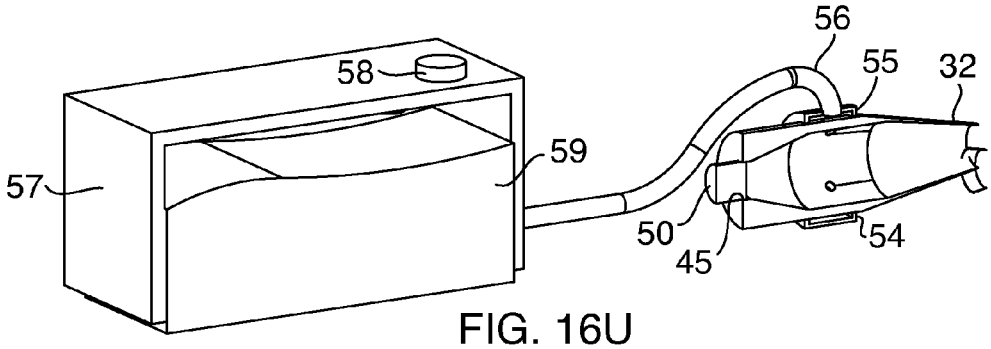

All of the previous ionizers ionize the medium through which the charged particle jet travels. Because the mass of the ions is millions of times less than the thrust mass, it is possible to use a material other than the medium to create ions. In a typical application, if the charged particle jet moves 25 pounds of the medium per second it will use less than one hundredth of a pound of the ionization material per hour. This opens the door to more efficient ion sources. If the ions are recirculated, even less will be needed. FIG. 16U shows the pointed ionizer electrode (32) being fed ionizing material from a tank (57) through a pipe (56) to a collar (55) containing a passage (54) around the pointed ionizer electrode. While the material (59) is shown as either a liquid or solid for clarity, it could also be a gas. The tank is filled through the filler (58). Not shown is a return tube to the tank where neutralized ions from the ion recirculator can be returned to the tank when no longer needed.

Figure 16V:
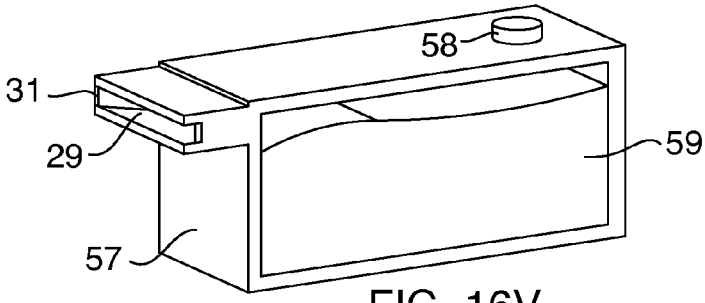

There have been several materials developed that are capable of being manufactured with a permanent charge. They are usually polycarbonate sheets or carbon nano-tubes. If these materials are made in the form of a very fine powder where they still retain their charge, they can be used as the charged particles for the charged particle jet. In this case, no ionizer is required. In FIG. 16V, a tank (57) of these charged particles (59) are placed in a tank where they can be held through the use of an electrostatic potential at the exit opening (29) of the tank. The output electrodes (31) serve both as the output valve and as deflection plates to sweep the charged particles across the region where needed. If both deflection plates are biased with respect to the interior of the tank to produce an electric field that keeps the charged particles in the tank, varying that field can be used to control the number of charged particles removed from the tank. Again, like the ionized medium of FIG. 16U, only a small mass of charged particles is needed if they are small enough and with recirculation few of the particles will leak out into the fluid medium through which the charged particle jet moves.

When low energy ions can be created, it opens up many new applications that like the charged particle jet engine only make sense when the energy of the charged particles is low. Low energy ions can be used to reduce frictional forces of objects moving relative to a medium. FIG. 17 illustrates this application.

Figure 17A:
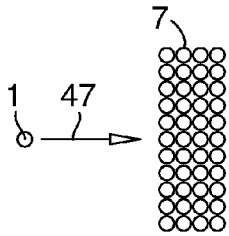
FIG. 17 shows ions used to reduce dynamic friction.
Figure 17B:
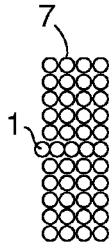
Figure 17C:
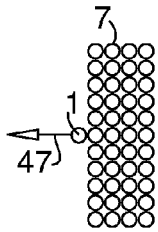
Figure 17D:
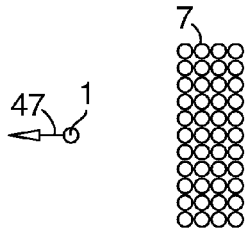
Figure 17E:
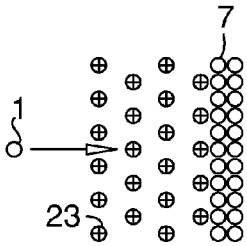
Figure 17F:
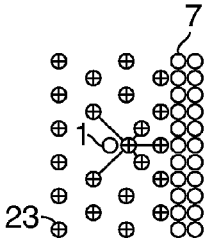
Figure 17G:
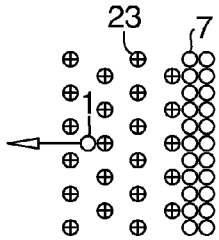
Figure 17H:
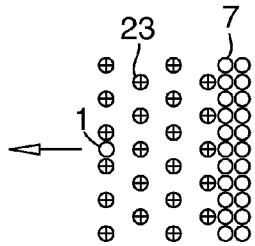
Figure 17I:
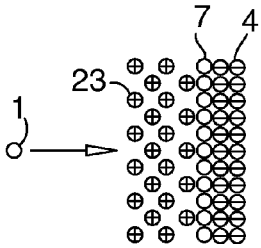
Figure 17J:
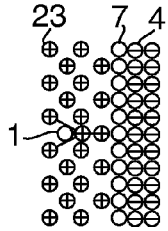
Figure 17K:
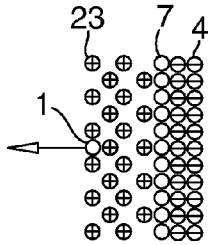
Figure 17L:
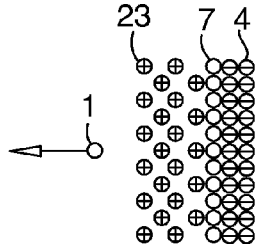

In FIG. 17A, a molecule (1) is traveling toward a wall (7). When it collides with the wall in FIG. 17B, it stops and transfers its energy to the wall. In FIG. 17C, the wall rebounds and returns some of the energy to the molecule (1) but as shown by the length of the arrow in FIG. 17D, some energy is lost to the wall, reducing the speed of the molecule (1) and heating up the wall (7).

A thin layer of charged particles (23) placed between the molecule and the wall (7) made of an insulating material can be used to shield the wall (7) from the molecules (1). The charged particles (23) repel each other and when one is hit by a neutral molecule (1) in FIG. 17F, it moves toward the other charged particles (23). The molecule (1) transfers its energy to the charged particles (23) that by their motion transfer the energy of the molecule (1) to the electric field between the charged particles (23). Just like hitting the wall (7), the charged particles (23) will rebound returning the energy to any molecules (1) it hits as shown in FIG. 12G. As shown by the length of the arrow in FIG. 17H, more of the energy is returned to the molecules (1) due to the collisions with the charged particles (23) being more elastic. With less energy removed from the molecules per collision, drag is reduced, as is the heating of the wall.

While the charged particles (23) can simply be a thin layer next to the wall (7), the electrostatic forces between the charged particles (23) will tend to disperse the charged particles (23) necessitating their replacement. In FIGS. 17I through 17L, an electrode (4) is placed on the opposite side of the wall (7) and forms a capacitor with the conducting charged particles (23) and the electrode (4) forming the plates of a capacitor with the wall (7) acting as the dielectric. A potential applied to the electrode and the conducting charged particles (23) will attract the charged particles (23) holding them to the wall (7). While the charged particles (23) will be packed closer together they will still be an effective elastic barrier to the molecules (1) of the medium. This is shown in FIGS. 17I through 17L.

Figure 17M:
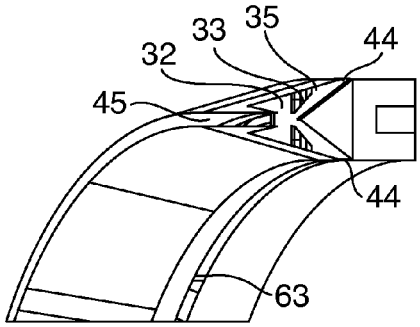
Figure 17N:
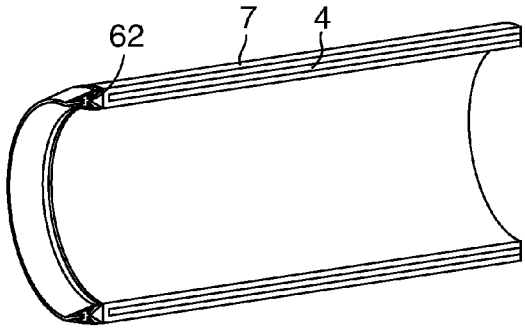

FIG. 17M shows an enlarged cutaway view of the region (62) of FIG. 17N. The ion generator is the ion generator of FIG. 11L wrapped around the tube (7) of FIG. 17N. The ion generator admits the medium through the inlet (45) and the hollow pointed electrode (32). The ion is created by the high voltage between the pointed electrode (32) and plate electrode (33) separated by insulated supports (63). The created ions pass through a hole in the plate electrode and are then slowed by the deceleration electrode (35). The ions are then split and leave the ion generator through the two exit ports (44). These ions spread out over both surfaces of the tube (7). Embedded in the tube wall is an electrode (4) that attracts the ions to both sides of the tube. This charged particle shield can easily be applied to the charged particle jet engine.

All of the separate elements of the charged particle jet engine are brought together in FIG. 18. FIG. 18A is a view of a complete self-contained unidirectional charged particle engine, one of many possible designs. In this version of the engine, ions are generated by a self-contained ion generator near the front ring with the medium intakes for the ion generator (45) at the front of the engine. FIG. 18B is a cutaway of the device shown in FIG. 18A. The ionizer surrounds the input electrode (3) and takes in air through the openings (45) and injects the created ions through the opening (44) just after the input electrode (3) inside the enclosed tube. Surrounding the jet tube (7) is a fuel cell (61) and the fuel for the fuel cell (60). The power supply (8) is located at the rear of the engine. This self-contained unit forms a complete charged particle jet engine.

Figure 18A:
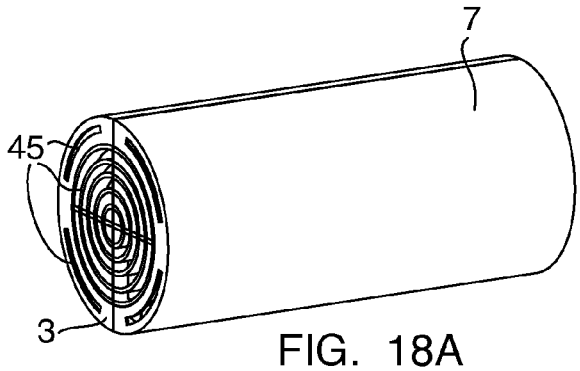
FIG. 18 shows an integrated charged particle jet engine complete with ion generator, power supply, and power source.
Figure 18B:
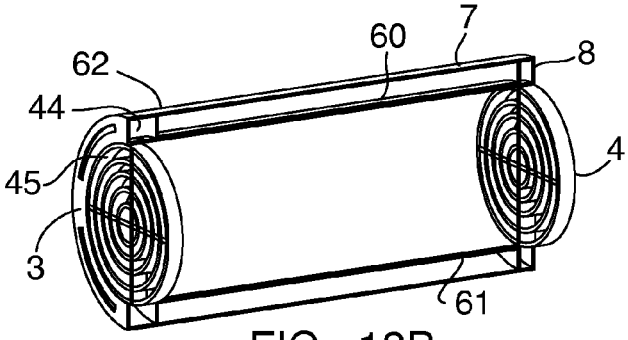
Figure 18C:
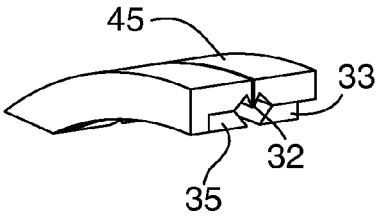
Figure 18D:
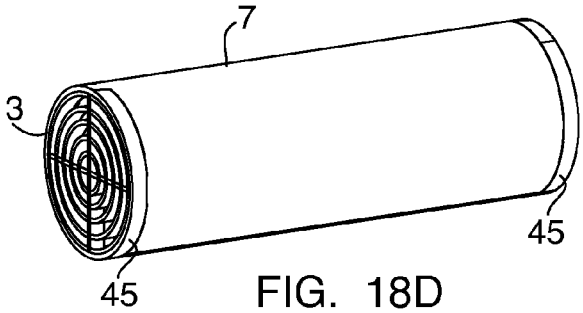
Figure 18E:
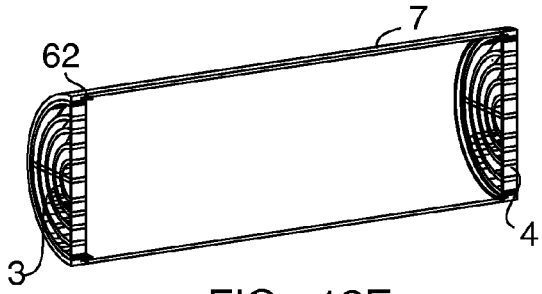

The engine shown in FIG. 18C through FIG. 18E is a bi-directional Charged particle jet engine that integrates the corona discharge ion generator of FIG. 16L with the electrodes (32), (33) and (35) placed radially behind each of the rings (62). The ion generator is shown in detail in FIG. 18C. This unit gets its power from an external source although it could also use the same self-contained power source shown in FIG. 18A and FIG. 18B.

All this leads up to the huge number of applications shown in FIG. 19 through FIG. 21. FIG. 19 illustrates many land based uses for the charged particle jet engine. FIG. 19A and FIG. 19B show a load (66) suspended below four of the self-contained modular charged particle jet engines (64) of FIG. 19 by cables (65). In this application, charged particle engines can take the place of forklifts, construction cranes, logging transporters, and other applications where a load must be lifted or moved. With the use of vectored thrust, these lifters cannot only lift the load but they can move the load in any direction. The lifter of FIG. 19A clusters the engines so that if one fails, the others can compensate for the lost engine. The lifter in FIG. 19B has the engines moved to the corners of the lifting platform (67) so that the accelerated air from the engines (64) do not impact on the platform (67) and the platform (67) can automatically be leveled by controlling the thrust of the four engines.

Figure 19A:
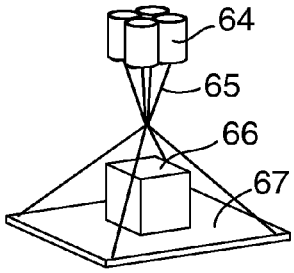
FIG. 19 shows several applications of the invention to various land based uses.
Figure 19B:
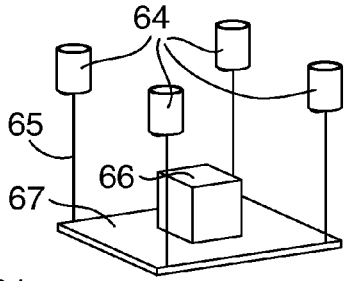
Figure 19C:
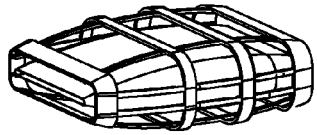

The Omnijet of FIG. 19C is a vehicle with multiple electrodes to provide vectored thrust in any direction and when operated on land near the ground can operate as a ground effects vehicle to lessen thrust requirements.

Figure 19D:
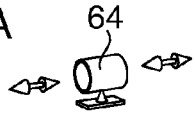

FIG. 19D is a simple fan using the charged particle jet. Its simplicity, efficiency light weight and lack of moving parts make for a very cost effective fan.

Figure 19E:
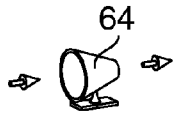

FIG. 19E, not showing the feed tubes, is a simple compressor using the charged particle jet.

Figure 19F:
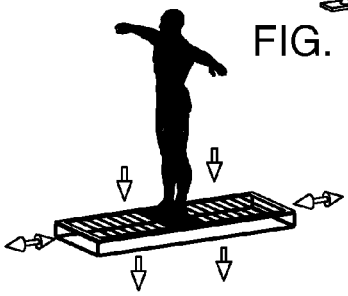

FIG. 19F shows the use of a flat charged particle jet to construct a floating skateboard. Again, vectored thrust and/or shifting body weight can be used to provide motion in any direction.

Figure 19G:
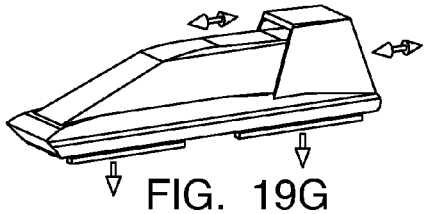

FIG. 19G is a dedicated version of a ground effect vehicle. The two charged particle jets facing down provide the ground effect air while the charged particle jet in the back provides forward and backward thrust. Directional control can again be obtained through vectored thrust.

Figure 19H:
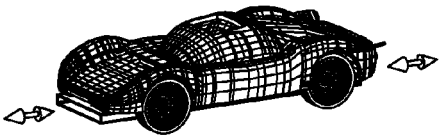
Figure 19I:
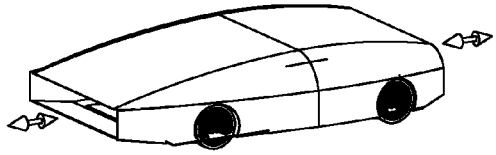

FIG. 19H is a conventional automobile retrofitted with a charged particle jet engine. The engine is placed under the floor pan with a large intake and exhaust. FIG. 19I shows an automobile that has been designed specifically for a charged particle engine. The automobile is designed to maximize the mass of air moved to maximize efficiency. Vectored thrust could be incorporated to improve road handling and the smoothness of the ride.

Figure 19J:
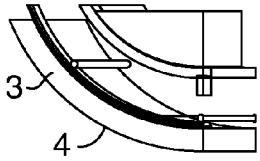
Figure 19K:
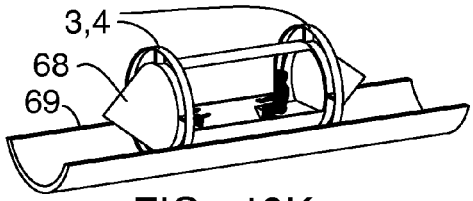
Figure 19M:
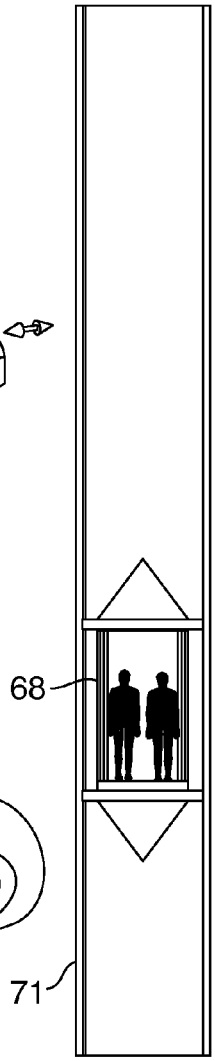
Figure 19L:
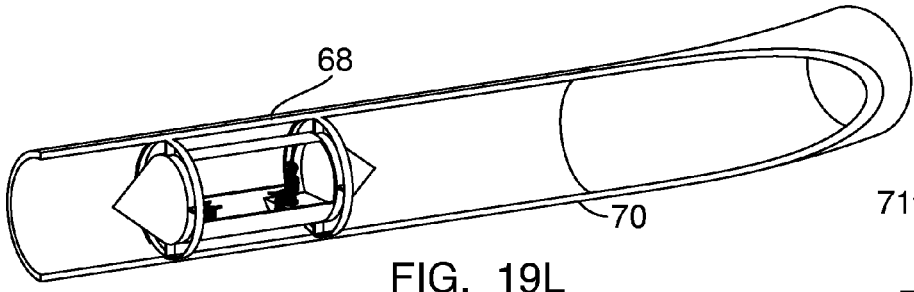

FIG. 19J and FIG. 19K show the use of a charged particle jet engine as a ground effect machine constrained in its motion by a track (69). In FIG. 19K, the two charged particle electrodes (3) and (4) provide forward and backward thrust. FIG. 19J shows a sectioned cutaway that shows a second set of electrodes (3) and (4) to force air under the vehicle to provide a ground effect cushion. The tracks (69) could be made out of any cheap material that can be extruded along the desired path. FIG. 19L shows the vehicle (68) of FIG. 19K operating in an enclosed tube (70). This would increase efficiency and could be used as both a subway below ground or as a suspended monorail above the ground. FIG. 19M shows the vehicle (68) of FIG. 19K operated vertically as an elevator constrained in its motion by a shaft (71) through which it travels.

FIG. 20 shows many water-based applications of the charged particle jet engine. While the ion source for the engine may differ from air based engines, the principles are the same. Because we are now dealing with a much denser liquid, smaller devices can be used for a given thrust and efficiency.

Figure 20A:
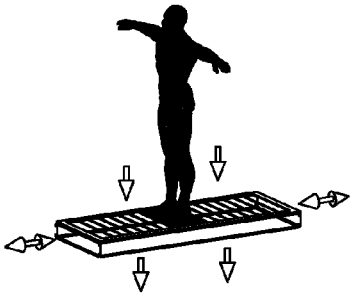
FIG. 20 shows several applications of the invention to various water based uses.

FIG. 20A shows the skateboard of FIG. 19F which can certainly be used over water. It can either use air as a skimmer over water or it could run on the surface like a self-propelled surfboard. Again, vectored thrust and/or shifting body weight can be used for steering and to keep the input of the board just under the surface of the water.

Figure 20B:
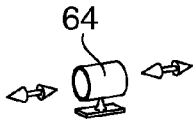

FIG. 20B is a simple water pump that is again, simple light weight, efficient, and with no moving parts.

Figure 20C:
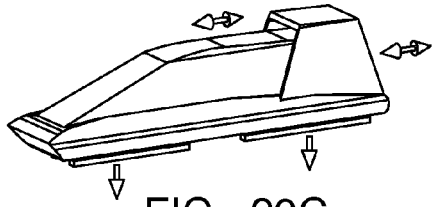
Figure 20D:
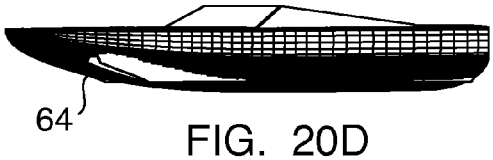
Figure 20E:
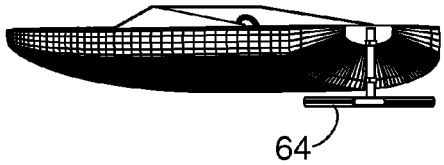
Figure 20F:
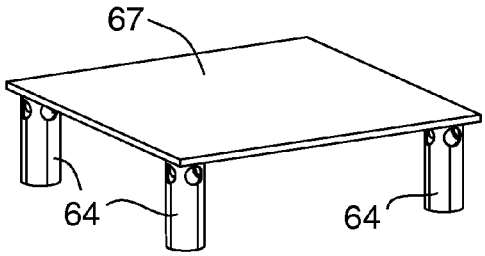
Figure 20G:
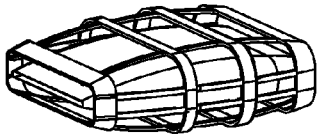

FIG. 20C is the ground effects machine of FIG. 20G operating over water. Like current ground effect machines, the charged particle jet ground effect vehicle would operate equally well over land and water since it would use air for both lift and propulsion. FIG. 20D and FIG. 20E show conventional boats powered by charged particle jet engines (64). FIG. 20D shows an inboard where the jets run through the hull to minimize the draft of the boat. FIG. 20E shows an outboard (64) at the stern of the boat. Both vectored thrust and/or rotation of the engine can be used for steering.

FIG. 20F shows a float or dock that is kept afloat by charged particle jets (64). Because of the increased density of water compared to air, greater thrust can be obtained using much less energy than would be need if air were used. One advantage of the use of charged particle jets (64) to float a platform (67) is that they can be used to keep the platform level as both the load shifts on the platform (67) and as it is rocked by waves. The charged particle jets do not have to supply all the buoyancy and can in fact just be stabilizers on a conventional buoyant floating platform.

FIG. 20G shows the Omnijet which can be used both on the water and below it if so designed. While the ion generators may have to be modified for dual medium use, the principles are again the same.

Figure 20H:
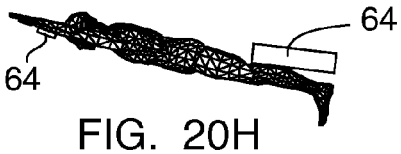

FIG. 20H shows a charged particle jet (64) attached to the boots of a person which can propel the person above, across or below the water. Active control of the magnitude and direction of thrust can provide dynamic stability without other complex mechanisms.

Figure 20I:
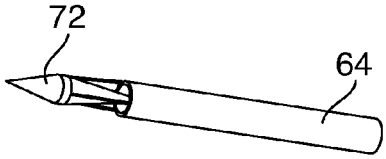

FIG. 20I shows a torpedo with the streamlined payload (72) ahead of the charged particle jet engine (64). Due to the simplicity, light weight, and efficiency, the speed, range and payload should be far greater than current devices.

Figure 20J:
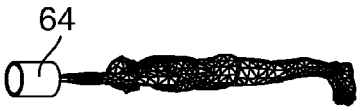

FIG. 20J shows a charged particle jet (64) used as a personal propulsion device for a diver.

Figure 20K:
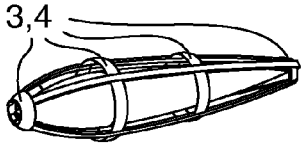

FIG. 20K shows a submarine built around charged particle jets for propulsion. The multiple electrodes (3,4) are used to provide vectored thrust in all directions.

Figure 20L:
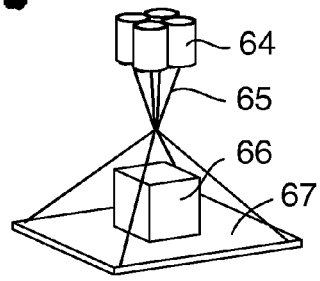
Figure 20M:
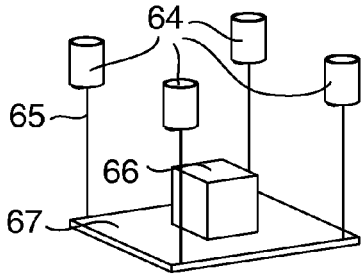

FIG. 20L and FIG. 20M are the lifters of FIG. 19A and FIG. 19B that can be used to raise various objects from the sea floor.

FIG. 21 shows various uses of the charged particle jet engine in the atmospheric and in space applications. FIG. 21A shows a vehicle for use at very high altitudes where the air density is very low. The large area jet rings help maintain relatively high efficiency at useful thrust levels. At altitudes of 50 miles or above, 100-foot diameter rings can produce 5,000 pounds of thrust using less than 100 kilowatts. At 100 miles, these same rings can produce the same 5,000 pounds of thrust using only a megawatt of power. Two hundred foot rings reduce the energy needed to produce 5,000 pounds of thrust to 360 kilowatts.

Figure 21A:
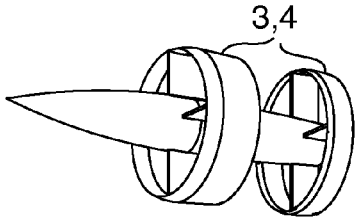
FIG. 21 shows several applications of the invention to various atmospheric based uses.
Figure 21B:
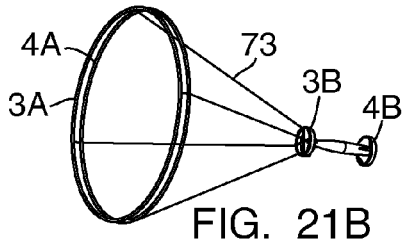

In near earth orbits, the medium through which the vehicle passes still contains a small particle density. The mechanism shown in FIG. 21B can be used to concentrate 35 these particles to increase thrust efficiency. This approach can also be used in the atmosphere to increase the density of the air entering the jet. While in theory, the size of the rings can simply be increased to compensate for the thin air density, eventually weight and strength become limiting factors in the size of the rings. In addition, using the same electric field strength for different medium densities is not very efficient. In FIG. 21B, the large pair of rings (3A) and (4A) form a charged particle jet engine. These rings are lightweight flexible structures that can be contained inside the actual vehicle and deployed when needed for added efficiency. These large rings when deployed are attached to the vehicle using long flexible wires (73) that also pass power to these rings. These "collection" rings are only required to supply the small thrust necessary to keep these rings ahead of the vehicle and to keep the flexible wires (73) taut. The ions that are used to supply this thrust are used to direct as much of the medium as possible to the input (3B) of the main charged particle jet (3B) and (4B).

Figure 21C:
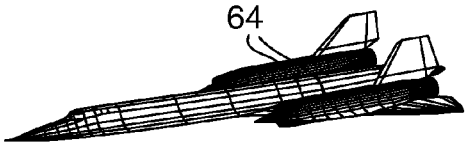

In FIG. 21C, we show a conventional SR71 type aircraft retrofitted with charged particle jet engines (64). Unlike conventional jet engines, the exhaust velocity of the charged particle jet engines can be much greater than the exhaust velocity of chemical jet or rocket engines.

Figure 21D:
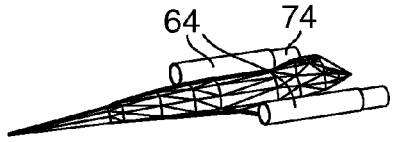

In FIG. 21D, we show an aircraft designed specifically for the ion jet engines (64). Because the number of ions needed increase with speed and charged particle jet inlet area, this airplane uses variable length engines (74) to reduce the number of ions needed at high speeds.

Figure 21E:
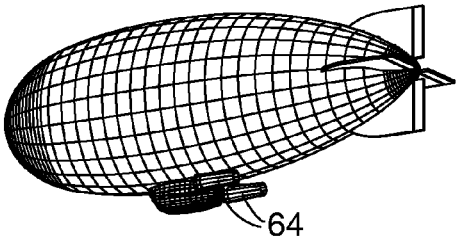

FIG. 21E shows a conventional blimp retrofitted with charged particle engines (64). These engines should produce much greater thrust for a given engine weight.

Figure 21F:
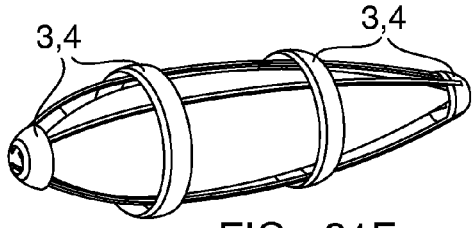

FIG. 21F is a new blimp design that can produce thrust in any direction. This can help stabilize the blimp in gusty weather.

Figure 21G:
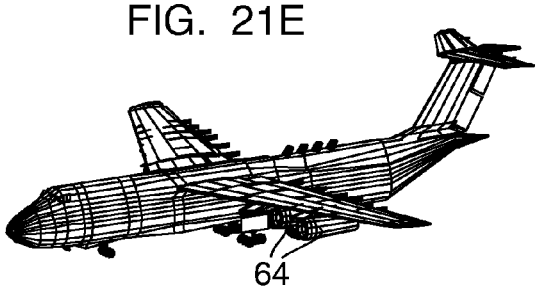

FIG. 21G shows charged particle jets retrofitted to a large capacity cargo plane. While the large energy requirements may make heavy lifter development slower than lighter weight applications, in time, these high power sources will be developed.

Figure 21H:
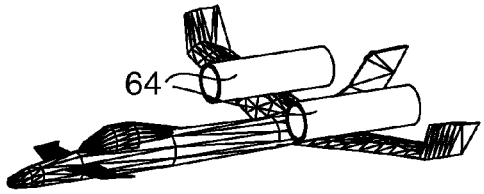

FIG. 21H is a new design for a general aviation aircraft based on charged particle jet engines. Because of the light weight of the charged particle jet engine, small lightweight personal aircraft should now be possible at a reasonable cost.

Figure 21J:
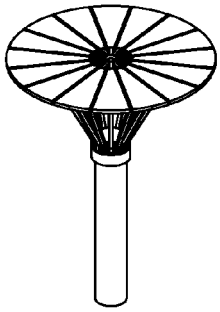
Figure 21K:
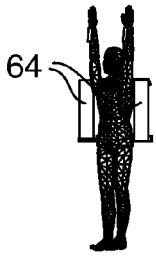
Figure 21I:
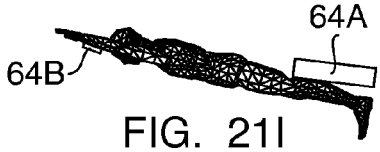
Figure 21L:
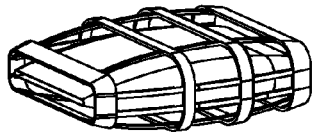

FIG. 21I is the same personal flying suit shown in FIG. 20H. Charged particle jet engines attached to the boots will give the person the sensation of simply standing on the ground as the thrust force will simply be through the feet. Small auxiliary charged particle jets attached to the hands give added control and stability. Active control of the magnitude and direction of thrust can provide dynamic stability without other complex mechanisms.

FIG. 21J is a large area charged particle jet engine that can be used as a solar powered surveillance platform that could stay airborne for weeks at a time.

FIG. 21K is a variation on the flying suit where the ion jets are attached to the person's sides. This configuration is more stable but is probably not as comfortable.

FIG. 21L is once again the Omnijet that can be used on land, sea, and air.

Figure 21M:
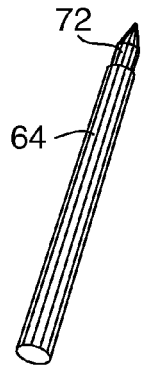

The final FIG. 21M is a guided missile. Like the torpedo, it is simply a warhead (72) with control electronics attached to a charged particle jet (64). The charged particle jet missile should be unmatched for both speed and range due to the light weight of the charged particle jet engine and its far greater efficiency over chemical rockets and jets.

What is claimed is:

1. A charged particle jet engine device comprising:

a source of charged particles to be accelerated by a charged particle accelerator;

a charged particle accelerator comprising a plurality of accelerating electrodes connected to at least one electrical potential, at least one of the electrodes being an exit electrode;

one or more electric fields produced by potential differences between electrodes;

at least one of said electrodes, when immersed in a gaseous or liquid medium, being configured to allow the medium to pass through or around it;

wherein the size, shape, and position of the electrodes in the medium create different regions of the medium used by the device;

low energy charged particles from the charged particle source introduced at any point in said medium or separated from other charged particles that are already in the medium such that the majority of charged particles in a region are of one polarity;

wherein these charged particles are accelerated by one or more electric fields produced by potential differences between electrodes;

wherein the accelerated charged particles travel a sufficient distance in the medium such that the number of collisions of said accelerated charged particles with neutral particles of the medium result in the transfer of energy and momentum from the charged particles to the neutral particles;

wherein the energy and momentum of the neutral particles that have collided with the accelerated charged particles exceeds the remaining mass, energy and momentum of the accelerated charged particles after leaving the region of the device where the charged particles were accelerated;

wherein all electrodes where the charged particles are neutralized after reaching or passing through or around said electrodes are exit electrodes; and wherein the charged particles are not created by high voltage ionization due to the electric fields of any of the exit electrodes so that the one or more electric fields of the charged particle accelerator regions which accelerate the charged particles is distinct from any electric fields associated with the source of charged particles.

2. A charged particle jet engine device comprising:

a source of charged particles; and a charged particle accelerator comprising;

a plurality of accelerating electrodes connected to at least one electrical power source having at least one electric field associated therewith;

at least one of said electrodes, when immersed in a gaseous or liquid medium, being configured to allow the medium to pass through or around it;

wherein the size, shape, and position of the electrodes in the medium create different regions of the medium used by the device;

low energy charged particles introduced at any point in said medium or separated from other charged particles that are already in the medium such that the majority of charged particles in a region are of one polarity;

wherein these charged particles are accelerated by one or more electric fields produced by potential differences between electrodes;

wherein the accelerated charged particles travel a sufficient distance in the medium such that the number of collisions of said accelerated charged particles with neutral particles of the medium result in the transfer of energy and momentum from the charged particles to the neutral particles;

wherein the energy and momentum of the neutral particles that have collided with the accelerated charged particles exceeds the remaining mass, energy and momentum of the accelerated charged particles after leaving the region of the device where the charged particles were accelerated; and wherein the charged particles are not created by high voltage ionization due to the electric fields of any of the accelerating electrodes so that the one or more electric fields of the charged particle accelerator regions which accelerate the charged particles is distinct from any electric fields associated with the source of charged particles.

3. The charged particle jet engine of claim 1 wherein one or more of the electrodes enclose an area and the area enclosed by the one or more electrodes is variable.

4. The charged particle jet engine device of claim 1 wherein one or more of the electrodes neutralizes some or all of the charged particles passing through or around the electrode.

5. The charged particle jet engine device of claim 1 wherein the electrodes are held together and supported by at least one structure insulated from at least one electrode and wherein such structure is of sufficient strength to withstand the mechanical and electrostatic forces placed on it and on any material or structure attached to it.

6. The charged particle jet engine device of claim 5 wherein the electrodes are held together and supported by a plurality of structures and wherein each of such structures is rigid.

7. The charged particle jet engine device of claim 5 wherein the electrodes are held together and supported by a plurality of structures and wherein the structures are adjustable such that both the spacing and orientation of the electrodes with respect to each other can be adjusted.

8. The charged particle jet engine device of claim 5 wherein at least one structure supporting the electrodes comprises a first structure and further comprising a second structure of sufficient strength to withstand any mechanical and electrostatic forces placed on it and on any material or structure attached to it and wherein means are provided to transfer the thrust, momentum, energy, and motion of the first structure to the second structure.

9. The charged particle jet engine device of claim 5 wherein at least one of the structures through which the medium cannot flow is used to control and direct the medium flow.

10. The charged particle jet engine device of claim 1 wherein at least two of the electrodes establish an electric field and wherein means are provided to reduce the axial space charge generated electric field produced when charged particles are between the electrodes.

11. The charged particle jet engine device of claim 10 wherein the axial space charge generated electric field is reduced by a nonuniform electric field perpendicular to the axial space charge generated electric field.

12. The charged particle jet engine device of claim 10 where the axial space charge generated electric field is reduced by a nonuniform charge density.

13. The charged particle jet engine device of claim 1 further comprising additional electrodes for reducing the axial space charge generated electric field.

14. The charged particle jet engine device of claim 10 further comprising axial charged particle insulated channels and wherein the axial space charge generated electric field is reduced by the axial charged particle insulated channels.

15. The charged particle jet engine device of claim 10 wherein the axial space charge generated electric field is reduced by at least one axial thrust producing region and wherein the charged particles are of a polarity where the space charge generated electric fields of at least one of the regions can be made to partially or completely cancel the space charge generated electric fields of at least one of the other regions.

16. The charged particle jet engine device of claim 15 wherein the axial space charge generated electric field is reduced by at least one axial thrust producing region wherein the charged particles are of a polarity where the space charge generated electric fields of at least one of the regions can be made to partially or completely cancel the space charge generated electric fields of at least one of the other regions and wherein the regions are coaxial.

17. The charged particle jet engine device of claim 1 wherein a space charge limited current flow is generated by the flow of charged particles and wherein the space charge limited current flow is increased through the use of a diffusion current.

18. The charged particle jet engine device of claim 1 wherein the device, when operating, comprises a reaction mass having a random thermodynamic energy and wherein some of the random thermodynamic energy of the reaction mass is recovered.

19. The charged particle jet engine device of claim 1 wherein the device, when operating, comprises a reaction mass having a random thermodynamic energy and wherein the random thermodynamic energy of the reaction mass is converted into additional thrust.

20. The charged particle jet engine device of claim 1 wherein the device further comprises thrust producing regions and wherein the thrust producing regions are segmented to create additional thrust.

21. The charged particle jet engine device of claim 20 further comprising additional electrodes to segment the thrust producing regions to create additional thrust and wherein each succeeding electrode is operated at a higher potential than the one before it.

22. The charged particle jet engine device of claim 1 further comprising a second charged particle jet engine wherein the neutralized medium output of one charged particle jet engine is allowed to flow into the input of a second charged particle jet engine forming a tandem pair of charged particle jet engines.

23. The charged particle jet engine device of claim 1 wherein the charged particles are neutralized when they are no longer needed.

24. The charged particle jet engine device of claim 1 further comprising an ion recirculator for recirculating charged particles from a region where the charged particles are no longer of use back to a region where they can be used again.

25. The charged particle jet engine device of claim 24 whereby the charge on the charged particles is used to separate the charged particles from the neutral particles of the medium.

26. The charged particle jet engine device of claim 1 further comprising a means to increase the mass flow of the medium into some region of the device.

27. The charged particle jet engine device of claim 1 wherein the medium density is increased within one or more regions of the device.

28. The charged particle jet engine device of claim 1 wherein the trajectory of the charged particles is altered to change the direction of the particle acceleration thus producing vectored thrust.

29. The charged particle jet engine device of claim 1 wherein the trajectory of the neutral particles is altered thus producing vectored thrust.

30. The charged particle jet engine device of claim 1 further comprising a charged particle generator wherein charged particles are injected into one or more regions from the charged particle generator.

31. The charged particle jet engine device of claim 30 wherein the charged particle generator is an ion generator.

32. The charged particle jet engine device of claim 1 wherein at least two of the electrodes comprise an ion generator and wherein charged particles are introduced into one or more regions by direct ionization of neutral particles from the medium in the region.

33. The charged particle jet engine device of claim 1 wherein charged particles exist in the medium and are separated into one or more regions of the device.

34. The charged particle jet engine device of claim 1 wherein the charged particles are statically charged particles.

35. The charged particle jet engine device of claim 1 wherein the amount of thrust is controlled by the amount of energy transferred to the charged particles.

36. The charged particle jet engine device of claim 35 wherein the amount of energy transferred to the charged particles is controlled by the strength of the electric field between the accelerating electrodes.

37. The charged particle jet engine device of claim 35 wherein the amount of energy transferred to the charged particles is controlled by the number of charged particles accelerated by the electric field between the accelerating electrodes.

38. The charged particle jet engine device of claim 1 wherein the amount of thrust is controlled by the amount of the medium that is accelerated.

39. The charged particle jet engine device of claim 38 wherein the amount of the medium that is accelerated is controlled by charged particle distribution in the region between the accelerating electrodes.

40. The charged particle jet engine device of claim 1 comprising an ion generator, an ion acceleration section, a power supply, and control electronics.

41. The charged particle jet engine device of claim 40 wherein one or more of an ion generator, an ion acceleration section, a power source, a power supply, and control electronics is integrated into the structure of the charged particle jet engine device.

* * * * *